US011656005B2

(12) United States Patent
Lesmerises et al.

(10) Patent No.: US 11,656,005 B2
(45) Date of Patent: May 23, 2023

(54) CO2 COOLING SYSTEM AND METHOD FOR OPERATING SAME

(71) Applicant: Marc-André Lesmerises, Trois-Rivières (CA)

(72) Inventors: Marc-André Lesmerises, Trois-Rivières (CA); Tommy Dolbec, Batiscan (CA)

(73) Assignee: GESTION MARC-ANDRÉ LESMERISES INC., Trois-Rivières (CA)

( * ) Notice: Subject to any disclaimer, the term of this patent is extended or adjusted under 35 U.S.C. 154(b) by 997 days.

(21) Appl. No.: 15/143,203

(22) Filed: Apr. 29, 2016

(65) Prior Publication Data

US 2016/0320098 A1 Nov. 3, 2016

Related U.S. Application Data

(60) Provisional application No. 62/154,982, filed on Apr. 30, 2015.

(51) Int. Cl.
*F25B 9/10* (2006.01)
*F25B 9/00* (2006.01)
(Continued)

(52) U.S. Cl.
CPC ..... *F25B 9/008* (2013.01); *F25B 5/02* (2013.01); *F25B 9/10* (2013.01); *F25B 41/20* (2021.01);
(Continued)

(58) Field of Classification Search
CPC .. F25B 9/008; F25B 9/10; F25B 41/04; F25B 41/00; F25B 5/02; F25B 43/00;
(Continued)

(56) References Cited

U.S. PATENT DOCUMENTS 63,404 A 4/1867 Lowe
73,936 A 1/1868 Somes
(Continued)

FOREIGN PATENT DOCUMENTS

CA 2283605 A1 3/2001
CA 2369330 A1 8/2002
(Continued)

OTHER PUBLICATIONS

Pearson, Carbon dioxide—new uses for an old refrigerant. International Journal of Refrigeration, 2005, vol. 28, p. 1140-1148.
(Continued)

*Primary Examiner* — Brian M King
(74) *Attorney, Agent, or Firm* — Merchant & Gould P.C.

(57) ABSTRACT

A $CO_2$ cooling system includes a compression stage in which $CO_2$ refrigerant is compressed; a cooling stage in which the $CO_2$ refrigerant releases heat; a $CO_2$ liquid receiver in which the $CO_2$ refrigerant is accumulated in liquid and gaseous states; an evaporation stage in which the $CO_2$ refrigerant, having released heat in the cooling stage, absorbs heat. The evaporation stage has first and second evaporation sectors; a first metering device for feeding $CO_2$ refrigerant into the first evaporation sector at a first pressure; and a second metering device for feeding $CO_2$ refrigerant into the second evaporation sector at a second pressure. The first metering device and the second metering device are operated independently from one another. A plurality of $CO_2$ transfer lines connects the compression stage, the cooling stage, the $CO_2$ liquid receiver and the evaporation stage. The $CO_2$ refrigerant is circulable in a closed-loop circuit.

6 Claims, 11 Drawing Sheets

(51) Int. Cl.

| | |
|---|---|
| ***F25C 3/02*** | (2006.01) |
| ***F25B 5/02*** | (2006.01) |
| ***F25B 43/00*** | (2006.01) |
| ***F25B 43/02*** | (2006.01) |
| ***F25B 49/02*** | (2006.01) |
| ***F25B 41/20*** | (2021.01) |
| *F25B 41/00* | (2021.01) |
| *F25B 6/02* | (2006.01) |

(52) U.S. Cl.
CPC ..... *F25B 43/00* (2013.01); *F25B 43/006* (2013.01); *F25B 43/02* (2013.01); *F25B 49/02* (2013.01); *F25C 3/02* (2013.01); *F25B 6/02* (2013.01); *F25B 41/00* (2013.01); *F25B 2309/061* (2013.01); *F25B 2339/047* (2013.01); *F25B 2400/075* (2013.01); *F25B 2500/07* (2013.01); *F25B 2600/2511* (2013.01); *F25B 2700/191* (2013.01); *F25B 2700/21* (2013.01)

(58) Field of Classification Search
CPC ..... F25B 43/02; F25B 43/006; F25B 49/02; F25B 6/02; F25B 2400/075; F25B 2339/047; F25B 2309/061; F25B 2500/07; F25B 2600/2511; F25B 2700/21; F25B 2700/191; F25C 3/02
See application file for complete search history.

(56) References Cited

U.S. PATENT DOCUMENTS

| | | | |
|---|---|---|---|
| 118,649 | A | 8/1871 | Sears |
| 152,269 | A | 6/1874 | Beins |
| 196,653 | A | 10/1877 | Gamgee |
| 308,965 | A | 12/1884 | Henderson |
| 663,456 | A | 12/1900 | Muller |
| 1,923,472 | A | 8/1933 | Baird |
| 3,001,374 | A | 9/1961 | Hutton, Jr. |
| 3,307,372 | A | 3/1967 | Kenison |
| 3,400,550 | A | 9/1968 | Guiffre |
| 3,672,181 | A | 6/1972 | Tyree, Jr. |
| 4,510,761 | A | 4/1985 | Quarles |
| 5,245,836 | A | 9/1993 | Lorentzen et al. |
| 5,497,631 | A | 3/1996 | Lorentzen et al. |
| 6,021,646 | A | 2/2000 | Burley et al. |
| 6,216,481 | B1 | 4/2001 | Kantchev |
| 6,540,605 | B1 | 4/2003 | Lesage |
| 6,595,009 | B1 | 7/2003 | Howard et al. |
| 6,694,763 | B2 | 2/2004 | Howard |
| 6,807,813 | B1 | 10/2004 | Lesage |
| 6,962,059 | B2 | 11/2005 | Okaza et al. |
| 7,096,679 | B2 | 8/2006 | Manole |
| 7,197,886 | B2 | 4/2007 | Lesage et al. |
| 7,210,303 | B2 | 5/2007 | Zhang et al. |
| 7,231,775 | B2 | 6/2007 | Dilk et al. |
| 7,310,960 | B2 | 12/2007 | Sienel et al. |
| 7,401,473 | B2 | 7/2008 | Lesage et al. |
| 7,530,235 | B2 | 5/2009 | Yamaguchi et al. |
| 7,644,593 | B2 | 1/2010 | Duraisamy |
| 7,716,943 | B2 | 5/2010 | Seefeldt |
| 7,721,569 | B2 | 5/2010 | Manole |
| 7,845,190 | B2 | 12/2010 | Pearson |
| 7,891,201 | B1 | 2/2011 | Bush et al. |
| 7,900,467 | B2 | 3/2011 | Allen |
| 8,316,654 | B2 | 11/2012 | Heinbokel et al. |
| 2001/0023594 | A1 | 9/2001 | Ives |
| 2006/0266058 | A1 | 11/2006 | Nemoto et al. |
| 2007/0199337 | A1 | 8/2007 | Otake et al. |
| 2007/0214829 | A1 | 9/2007 | Otake et al. |
| 2008/0011004 | A1 | 1/2008 | Lesage et al. |
| 2008/0223074 | A1 | 9/2008 | Pachai et al. |
| 2008/0289350 | A1 | 11/2008 | Shapiro |
| 2009/0120108 | A1 | 5/2009 | Heinbokel et al. |
| 2009/0260389 | A1* | 10/2009 | Dube ..... C09K 5/041 62/430 |
| 2010/0023166 | A1 | 1/2010 | Chessel et al. |
| 2010/0147006 | A1 | 6/2010 | Taras et al. |
| 2011/0011104 | A1 | 1/2011 | Lesage et al. |
| 2011/0265983 | A1 | 11/2011 | Pedersen |
| 2012/0055182 | A1* | 3/2012 | Dube ..... F24F 3/1417 62/81 |
| 2012/0073319 | A1* | 3/2012 | Dube ..... F25B 9/008 62/235 |
| 2012/0247148 | A1 | 10/2012 | Dube |

FOREIGN PATENT DOCUMENTS

| | | | |
|---|---|---|---|
| CA | 2599769 | A1 | 2/2009 |
| CA | 2662986 | A1 | 10/2009 |
| CA | 2760488 | A1 | 10/2009 |
| CA | 2638235 | A1 | 2/2010 |
| CA | 2738874 | A1 | 4/2010 |
| CA | 2744840 | A1 | 4/2010 |
| CA | 2744858 | A1 | 4/2010 |
| CA | 2735347 | A1 | 6/2011 |
| CA | 2746445 | A1 | 10/2011 |
| CA | 2724255 | A1 | 3/2012 |
| CA | 2771113 | A1 | 5/2012 |
| EP | 1794516 | B1 | 6/2007 |
| EP | 1921399 | A2 | 5/2008 |
| JP | 2001241785 | A | 9/2001 |
| JP | 2004101107 | A | 4/2004 |
| JP | 2004108617 | A | 4/2004 |
| JP | 2004339741 | A | 12/2004 |
| JP | 2006292229 | A | 10/2006 |
| JP | 4106685 | B2 | 6/2008 |
| JP | 2009036415 | A | 2/2009 |
| JP | 4241662 | B2 | 3/2009 |
| JP | 4987610 | B2 | 7/2012 |
| WO | 2002066908 | A1 | 8/2002 |
| WO | 2006087011 | A1 | 8/2006 |
| WO | 2007022777 | A1 | 3/2007 |
| WO | 2007022778 | A1 | 3/2007 |
| WO | 2010045743 | A1 | 4/2010 |

OTHER PUBLICATIONS

Girotto et al., Commercial refrigeration system using CO2 as the refrigerant, International Journal of Refrigeration, 2004, vol. 27, p. 717-723.
Neska, CO2 heat pump systems, International Journal of Refrigeration, 2002, vol. 25, p. 421-427.
Opazo et al., Theoretical analysis of a CO2—NH3 cascade refrigeration system for cooling applications at low temperatures, Applied Thermal Engineering, 2009, vol. 29, p. 1577-1583.
Rogstam, Ice rinks with carbon dioxide as secondary refrigerant, IUC Sveriges energi & Kyl centrum, 2010, p. 1-32.
Kauf, Determination of the optimum high pressure for transcritical CO2—refrigeration cycles, International Journal of Thermal Science, 1999, vol. 38, p. 325-330.
Li et al., Transcritical CO2 refrigeration cycle with ejector-expansion device, International Journal of Refrigeration, 2005, vol. 28. p. 766-773.
Fangtian et al., Thermodynamic analysis of transcritical CO2 refrigeration cycle with an ejector, Applied Thermal Engineering, 2011, vol. 31, p. 1184-1189.
Eskandari et al., Performance of a new two-stage multi-intercooling transcritical CO2 ejector refrigeration cycle, Applied Thermal Engineering, 2012, vol. 40, p. 202-209.
Adriansyah, W., Combined Air-Conditioning and Tap Water Heating Plant, Using CO2 as Refrigerant for Indonesian Climate Condition, Thesis, Norwegian University of Science and Technology, Faculty of Mechanical Engineering, Department of Refrigeration and Air-conditioning, Apr. 2001, 238 pages, USA.
Vestergaard et al., CO2 in Refrigeration Applications, The News Magazine, Oct. 2, 2013.
Kim, S. et al., The Performance of a Transcritical CO2 Cycle With an Internal Heat Exchanger for Hot Water Heating, International Journal of Refrigeration, Nov. 2005, p. 1064-1072, vol. 28, No. 7.

(56) References Cited

OTHER PUBLICATIONS

Rogstam, J., Ice Rink Refrigeration System With CO2 as Secondary Fluid, IIR International conference on Thermophysical Properties and Transfer Processes of Refrigerants. Vicenza, Italy. Aug. 30-31, 2005.
Shahzad, K., An Ice Rink Refrigeration System Based On CO2 as Secondary Fluid in Copper Tubes, Master of Science Thesis, Master Program of Sustainable Energy Engineering, Department of Energy Technology, Royal Institute of Technology, 2006, 80 pages, Stockholm, Sweden.
Nilsson et al., Ice Rink Refrigeration System With Carbon Dioxide as Secondary Fluid in Copper Tubes, 7th IIR Gustav Lorentzen Conference on Natural Working Fluids, 8 pages, May 28-31, 2006, Norway.
Rogstam, J. Energy Analysis of Backavallen Ice rink Refrigeration system with CO2 as heat transfer liquid in Copper tubes, Jorgen Rogstam, John Prakash, IUC Sveriges energi & kyl centrum. 2007.
Sawalha, S., Carbon Dioxide in Supermarket Refrigeration, Doctoral Thesis, KTH Industrial engineering and management, 2008, Sweden.
Cofely GDF Suez, Customized Industrial Refrigeration Firmly Established at Cofely, Brochure, 16 pages, 2009, Germany.
Nielson, P. et al., Introducing a New AMMONIA/CO2 Cascade Concept for Large Fishing Vessels, York Refrigeration, IIAR ammonia refrigeration conference, 17 pages, 2003, Albuquerque, New Mexico.
Nielson, P. et al., Introducing a New AMMONIA/CO2 Cascade Concept for Large Fishing Vessels, York Refrigeration, IIAR ammonia refrigeration conference, Technical Paper N. 11, 36 pages, 2003, Albuquerque, New Mexico.
Danfoss Refrigeration and Air Conditioning, CO2 Introduction, 19 pages.
Danfoss Refrigeration and Air Conditioning, Cascade Systems, Food Retail, 59 pages.
Carnot Refrigeration, Formation CO2, Training guide, 33 pages, Oct. 1, 2009, Trois-Rivière, Québec, Canada.
Coolsolutions, Le Réfrigérant CO2 Dans Un Supermarché De Sobeys, Canmeténergie, Natural Ressources Canada, 8 pages, Canada, 2009.
Rogstam J, Status of Transcritical CO2 Systems in Ice Rinks Prior to 2010, Energi & Kylanalys, 3 pages, Sweden.
Elbel, S. et al., Effect of Internal Heat Exchanger on Performance of Transcritical CO2 Systems With Ejector, Purdue e-Pubs, Purdue University, International Refrigeration and Air conditioning conference, 2004, 9 pages.
Hrnjak, P., Cascade Systems and Accomodating High Pressure, Creative Thermal Solutions Inc, 10th short course in Supermarket Refrigeration, 8 pages, Feb. 23-24, 2010, Illinois, USA.
Danfoss Refrigeration, Industrial Refrigeration Valves for CO2 Applications, Danfoss Application guide, p. 9, 2007.
Neska et al., CO2—A Refrigerant From the Past With Prospects of Being One of the Main Refrigerants in the Future, 9th IIR Gustav Lorentzen conference 2010, natural refigerants—real alternatives, Sydney, Apr. 12-14, 2010.
Bellstedt, M. et al., Application of CO2 (R744) Refrigerant in Industrial Cold Storage Refrigeration Plant, Forum Application, The official journal of ARAH, p. 25-30, Jun. 2002.
Campbell, A. et al., R-744 (CO2) as a Refrigerant, International Journal of Low Carbon Technologies 2/1, 4 pages, 2007.
Sawalha, S., Theoretical Evaluation of Trans-Critical CO2 Systems in Supermarket Refrigeration. Part I: Modeling, Simulation and Optimization of Two System Solutions, Science Direct, International journal of refrigeration, N. 31, p. 516-524, 2008.
Sawalha, S., Theoretical Evaluation of Trans-Critical CO2 Systems in Supermarket Refrigeration. Part II System Modifications and Comparisons of Different Solutions, Science Direct, International journal of refrigeration, N. 31, p. 529-534, 2008.
Nguyen, T, Carbon Dioxide in Ice Rink Refrigeration, Kth Industrial Engineering and Management, 65 pages, Sep. 2012.
Danfoss Refrigeration and Air Conditioning, Designing CO2 Systems—Danfoss system solution for CO2 based refrigeration.
Cupori, Cupori 240 Copper Tubing Developped for Ice Rink Installations, 21 pages, 2012.
Sharp, D., Cupori, Winter Sports Arena, 26 pages, Nov. 26, 2009.
Ericsson, CO2 as Refrigerant in a Two-Phase Thermosyphon for Cooling Electronics, 3 pages.
Bertsch, S., Modeling of a CO2 Thermosyphon for a Ground Source Heat Pump Application, Purdue University, 12 pages, USA, 2005.
Industri & Laboratoriekyl, Offer 50119 H, Appendix 2, 2006, 4 pages, Stockholm.
Backavallen et al., Katrineholms Kommun, WSP, WS-Teknik, 18 pages, 2005, Stockholm.
Green and Cool Green Refrigeration Systems, Drawing 1121-3, Arctis, Mistral D03226 LT + D01117, Indoor MT Unit System drawing, 1 page, 2009.
Carel, Solutions for the Use of CO2 In Commercial Refrigeration, Technology and evolution, 'lo pages, Italy, 2007.

* cited by examiner

| LEGEND | |
|---|---|
| Compressor | |
| Pump | |
| Isolation valve | |
| Check valve | |
| Motorized valve | |
| Solenoid valve | |
| Expansion valve | |
| P differential unit | |
| Electronic expansion valve | |
| Pressure sensor | P |
| Temperature sensor | T |
| Float level sensor | |
| Insulator | |
| Dryer | dryer |
| Oil separator | |
| Heat exchanger | |
| Pressure relief valve | |
| Overpressure check | |

FIG. 6

CO2 COOLING SYSTEM AND METHOD FOR OPERATING SAME

CROSS-REFERENCE TO RELATED APPLICATIONS

This application claims benefit under 35USC § 119(e) of US provisional patent application 62/154,982 filed Apr. 29, 2015, the specification of which is hereby incorporated by reference.

TECHNICAL FIELD

The technical field generally relates to $CO_2$ cooling systems and to a method for operating a $CO_2$ cooling system. More particularly, the invention relates to $CO_2$ refrigeration and air-conditioning systems.

BACKGROUND in the last few years, carbon dioxide ($CO_2$) made a come-back in refrigeration applications where it is used as a refrigerant fluid or coolant. This is mainly due to the concerns regarding the effects of refrigerants on ozone layer depletion and global warming. $CO_2$ is known as a naturally available, safe, environmental friendly refrigerant with good thermo-physical and transport properties.

In cooling systems, most of the energy costs come from the motors that drive compressors, fans, and pumps. In the case of an ice-covered surface such as an ice rink, while the use of $CO_2$ generally allows reducing the energy consumption of the cooling system due to possible higher heat reclaim, some sectors of the surface may require more refrigerant than others in order to maintain a similar ice quality. Similarly, for supermarkets and industrial applications, some sectors may require more refrigerant than others in order to respond to the cooling needs.

In view of the above, $CO_2$ cooling still has a number of challenges.

SUMMARY

It is therefore an aim of the present invention to address the above mentioned issues.

In accordance with an aspect, there is provided a $CO_2$ cooling system, comprising: a compression stage in which $CO_2$ refrigerant is compressed; a cooling stage in which the compressed $CO_2$ refrigerant releases heat; an evaporation stage in which the $CO_2$ refrigerant, having released heat in the cooling stage, absorbs heat. The evaporation stage comprises: a first evaporation sector and a second evaporation sector; a first $CO_2$ transfer line feeding a first portion of the $CO_2$ refrigerant from the cooling stage into the first evaporation sector, the first $CO_2$ transfer line comprising a first metering device mounted upstream the first evaporation sector; and a second $CO_2$ transfer line feeding a second portion of the $CO_2$ refrigerant from the cooling stage into the second evaporation sector, the second $CO_2$ transfer line comprising a second metering device mounted upstream the second evaporation sector and a $CO_2$ accumulator mounted upstream the second metering device. The first metering device and the second metering device are operated independently from one another, $CO_2$ pressure in the first evaporation sector being different than $CO_2$ pressure in the second evaporation. The $CO_2$ cooling system also comprises a plurality of $CO_2$ transfer lines connecting the compression stage, the cooling stage and the evaporation stage, and wherein the $CO_2$ refrigerant is circulable in a closed-loop circuit.

In an embodiment, the $CO_2$ cooling system further comprises a $CO_2$ liquid receiver located upstream of the first and the second metering devices and the $CO_2$ accumulator. The second $CO_2$ transfer line further comprises a pressure differential unit mounted between the $CO_2$ liquid receiver and the $CO_2$ accumulator.

In an embodiment, the first metering device comprises an expansion valve and the second metering device comprises a pump.

In a further embodiment, the $CO_2$ cooling system comprises a $CO_2$ transfer line transferring the $CO_2$ refrigerant exiting the evaporation stage to the compression stage.

In an embodiment, the $CO_2$ accumulator is mounted in the $CO_2$ transfer line transferring the $CO_2$ refrigerant exiting the evaporation stage to the compression stage.

In yet a further embodiment, the $CO_2$ cooling system further comprises a pressure regulating unit mounted to at least one of the first and second transfer line upstream of the $CO_2$ liquid receiver.

In an embodiment, the evaporation stage comprises a circuit of pipes extending under an ice-playing surface. The circuit of pipes includes at least one first pipe line corresponding to the first evaporation sector and at least one second pipe line corresponding to the second evaporation sector.

In an embodiment, the at least one first pipe line extends below a central section of the ice-playing surface; and the at least one second pipe line extends below an outer section of the ice-playing surface.

In accordance with an aspect, $CO_2$ pressure in the first evaporation sector is higher than $CO_2$ pressure in the second evaporation sector.

In another embodiment, downstream of a respective one of the first and second metering devices, at least one of the first and second $CO_2$ transfer lines is divided into a plurality of $CO_2$ transfer sub-lines. Each one of the $CO_2$ transfer sub-lines comprises a controllable metering device supplying $CO_2$ refrigerant to the respective one of the first and the second evaporation sectors.

In accordance with another aspect, there is provided a $CO_2$ cooling system, comprising: a compression stage in which $CO_2$ refrigerant is compressed; a cooling stage in which the compressed $CO_2$ refrigerant releases heat; a $CO_2$ liquid receiver in which the $CO_2$ refrigerant, exiting the cooling stage, is accumulated in liquid and gaseous states; an evaporation stage in which the $CO_2$ refrigerant, having released heat in the cooling stage, absorbs heat. The evaporation stage comprises: a first evaporation sector and a second evaporation sector; a first $CO_2$ transfer line feeding a first portion of the $CO_2$ refrigerant from the cooling stage into the first evaporation sector, the first $CO_2$ transfer line comprising a first metering device mounted upstream the first evaporation sector, the first $CO_2$ transfer line by-passing the $CO_2$ liquid receiver; and a second $CO_2$ transfer line feeding a second portion of the $CO_2$ refrigerant exiting the $CO_2$ liquid receiver into the second evaporation sector, the second $CO_2$ transfer line comprising a second metering device mounted upstream the second evaporation sector. The first metering device and the second metering device are operated independently from one another. The $CO_2$ cooling system also comprises a plurality of $CO_2$ transfer lines connecting the compression stage, the cooling stage, the $CO_2$ liquid receiver and the evaporation stage and wherein the $CO_2$ refrigerant is circulable in a closed-loop circuit.

In an embodiment, the first metering device comprises an expansion valve and the second metering device comprises a pump.

In another embodiment, the $CO_2$ cooling system comprises a $CO_2$ transfer line transferring the $CO_2$ refrigerant exiting the evaporation stage to the compression stage.

In a further embodiment, the $CO_2$ cooling system comprises a $CO_2$ accumulator mounted to the $CO_2$ transfer line extending between the evaporation stage and the compression stage.

In an embodiment, the $CO_2$ cooling system further comprises a pressure regulating unit mounted to at least one of the first and second transfer line upstream of the $CO_2$ liquid receiver.

In yet another embodiment, the $CO_2$ cooling system comprises a $CO_2$ transfer line transferring a portion of the $CO_2$ refrigerant from the $CO_2$ liquid receiver to the $CO_2$ accumulator. The $CO_2$ transfer line includes a pressure differential unit mounted downstream the $CO_2$ liquid receiver and upstream the $CO_2$ accumulator.

In an embodiment, the evaporation stage comprises a circuit of pipes extending under an ice-playing surface. The circuit of pipes includes at least one first pipe line corresponding to the first evaporation sector and at least one second pipe line corresponding to the second evaporation sector.

In another embodiment, the at least one first pipe line extends below a central section of the ice-playing surface; and the at least one second pipe line extends below an outer section of the ice-playing surface.

In a further embodiment, $CO_2$ pressure in the first evaporation sector is higher than $CO_2$ pressure in the second evaporation sector.

In another embodiment, downstream of a respective one of the first and second metering devices, at least one of the first and second $CO_2$ transfer lines is divided into a plurality of $CO_2$ transfer sub-lines. Each one of the $CO_2$ transfer sub-lines comprises a controllable metering device supplying $CO_2$ refrigerant to the respective one of the first and the second evaporation sectors.

In accordance with a further aspect, there is provided a method for operating a $CO_2$ cooling system. The $CO_2$ cooling system comprises: a compression stage in which $CO_2$ refrigerant is compressed; a cooling stage in which the $CO_2$ refrigerant releases heat; and an evaporation stage. The evaporation stage comprises a first evaporation sector and a second evaporation sector, and the $CO_2$ refrigerant having released heat in the cooling stage, absorbs heat. The method comprises: circulating the $CO_2$ refrigerant in a closed-loop circuit between the evaporation stage, the compression stage and the cooling stage. Circulating the $CO_2$ refrigerant comprises: conveying a first portion of the $CO_2$ refrigerant exiting the cooling stage into the first evaporation sector; conveying a second portion of the $CO_2$ refrigerant exiting the cooling stage to a $CO_2$ accumulator through a pressure differential unit, and conveying the second portion of the $CO_2$ refrigerant exiting the $CO_2$ accumulator into the second evaporation sector; and independently controlling a pressure of the $CO_2$ refrigerant in the first evaporation sector and a pressure of the $CO_2$ refrigerant in the second evaporation sector.

In an embodiment, the $CO_2$ cooling system further comprises a first metering device downstream of the cooling stage and upstream of the first evaporation sector; and a second metering device downstream of the $CO_2$ accumulator and upstream of the second evaporation sector. Conveying the first and the second portions of the $CO_2$ refrigerant comprises conveying a respective one of the first and the second portions through a respective one of the first and the second metering devices. The method further comprises independently controlling the first and the second metering devices so as to feed the first and the second portions of the $CO_2$ refrigerant to the respective one of the first and the second evaporation sectors, so that $CO_2$ pressure in the first evaporation sector is higher than $CO_2$ pressure in the second evaporation sector.

In a further embodiment, the $CO_2$ cooling system further comprises a $CO_2$ liquid receiver, in which the $CO_2$ refrigerant is accumulated in liquid and gaseous state, located upstream of the first and the second metering devices and the $CO_2$ accumulator. Conveying the first and the second portions of the $CO_2$ refrigerant comprises conveying the first and the second portions of the $CO_2$ refrigerant exiting the cooling stage to the $CO_2$ liquid receiver and then conveying the first and second portions of the $CO_2$ refrigerant to the respective one of the first metering device and the pressure differential unit provided upstream of the $CO_2$ accumulator.

In an embodiment, conveying the $CO_2$ refrigerant exiting the cooling stage to $CO_2$ liquid receiver comprises lowering a pressure of the $CO_2$ refrigerant by conveying at least one of the first and second portions of the $CO_2$ refrigerant between the cooling stage and the $CO_2$ liquid receiver through a pressure regulating unit.

In a further embodiment, the method comprises conveying the $CO_2$ refrigerant exiting the evaporation stage to the $CO_2$ accumulator, and then conveying a portion of the $CO_2$ refrigerant exiting the $CO_2$ accumulator to the compression stage.

In an embodiment, the method also comprises conveying the $CO_2$ refrigerant exiting the evaporation stage to the compression stage.

In yet another embodiment, the evaporation stage comprises a circuit of pipes extending under an ice-playing surface. The circuit of pipes includes at least one first pipe line corresponding to the first evaporation sector and extending below a central section of the ice-playing surface, and at least one second pipe line corresponding to the second evaporation sector and extending below an outer section of the ice-playing surface.

In an embodiment, the method comprises monitoring $CO_2$ pressure in the $CO_2$ liquid receiver; and controlling at least one of the pressure regulating unit, the pressure differential unit, the first metering device and the second metering device so that $CO_2$ pressure in the $CO_2$ liquid receiver is maintain between 400 and 600 psi.

In another embodiment, the method comprises monitoring $CO_2$ pressure in the $CO_2$ liquid receiver; and controlling at least one of the pressure regulating unit, the pressure differential unit, the first metering device and the second metering device so that $CO_2$ pressure in the $CO_2$ liquid receiver is maintain between 450 and 550 psi.

In yet another embodiment, the method comprises monitoring $CO_2$ pressure in the $CO_2$ accumulator; and controlling at least one of the pressure differential unit, the first metering device and the second metering device so that $CO_2$ pressure in the $CO_2$ accumulator is maintain between 300 and 400 psi.

In accordance with another aspect, there is provided a method for operating a $CO_2$ cooling system. The $CO_2$ cooling system comprises a compression stage in which $CO_2$ refrigerant is compressed; a cooling stage in which the $CO_2$ refrigerant releases heat; a $CO_2$ liquid receiver in which the $CO_2$ refrigerant is accumulated in liquid and gaseous states; and an evaporation stage. The evaporation stage comprises first and second evaporation sectors, in which the $CO_2$ refrigerant having released heat in the cooling stage, absorbs heat. The method comprises: circulating the $CO_2$ refrigerant in a closed-loop circuit between the compression stage, the cooling stage, and the evaporation stage. Circulating the $CO_2$ refrigerant comprises: conveying a first portion of the $CO_2$ refrigerant exiting the cooling stage into the first evaporation sector, the first portion of the $CO_2$ refrigerant by-passing the $CO_2$ liquid receiver; conveying a portion of the $CO_2$ refrigerant exiting the cooling stage to the $CO_2$ liquid receiver, and conveying a second portion of the $CO_2$ refrigerant into the second evaporation sector; and independently controlling a pressure of the $CO_2$ refrigerant in the first evaporation sector and a pressure of the $CO_2$ refrigerant in the second evaporation sector.

In an embodiment, the $CO_2$ cooling system further comprises a first metering device downstream of the cooling stage and upstream of the first evaporation sector; and a second metering device downstream of the $CO_2$ liquid receiver and upstream of the second evaporation sector. Conveying the first and the second portions of the $CO_2$ refrigerant comprises conveying a respective one of the first and the second portions of the $CO_2$ refrigerant through a respective one of the first and the second metering devices. The method further comprises independently controlling the first and the second metering devices so as to feed the first and the second portions of the $CO_2$ refrigerant to a respective one of the first and the second evaporation sectors, so that $CO_2$ pressure in the first evaporation sector is higher than $CO_2$ pressure in the second evaporation sector.

In another embodiment, the $CO_2$ cooling system further comprises a $CO_2$ accumulator downstream the evaporation stage and upstream the compression stage. The method comprises conveying a portion of the $CO_2$ refrigerant exiting the $CO_2$ liquid receiver to the $CO_2$ accumulator through a pressure differential unit.

In a further embodiment, the method comprises conveying the $CO_2$ refrigerant exiting the evaporation stage to the $CO_2$ accumulator, and conveying the $CO_2$ refrigerant exiting the $CO_2$ accumulator to the compression stage.

In yet another embodiment, the method comprises conveying the $CO_2$ refrigerant exiting the evaporation stage to the compression stage.

In an embodiment, conveying the $CO_2$ refrigerant exiting the cooling stage to $CO_2$ liquid receiver comprises lowering a pressure of the $CO_2$ refrigerant by conveying the first and the second portions of the $CO_2$ refrigerant from the cooling stage to a respective one of the first metering device and the $CO_2$ liquid receiver through a pressure regulating unit.

In a yet another embodiment, the evaporation stage comprises a circuit of pipes extending under an ice-playing surface. The circuit of pipes includes at least one first pipe line corresponding to the first evaporation sector and extending below a central section of the ice-playing surface, and at least one second pipe line corresponding to the second evaporation sector and extending below an outer section of the ice-playing surface. Each of the at least first and second pipe line comprises a controllable metering device.

In an embodiment, the method comprises monitoring $CO_2$ pressure in the $CO_2$ liquid receiver; and controlling at least one of the pressure regulating unit, the first metering device and the second metering device so that $CO_2$ pressure in the $CO_2$ liquid receiver is maintain between 400 and 600 psi.

In another embodiment, the method comprises monitoring $CO_2$ pressure in the $CO_2$ liquid receiver; and controlling at least one of the pressure regulating unit, the first metering device and the second metering device so that $CO_2$ pressure in the $CO_2$ liquid receiver is maintain between 450 and 550 psi.

In yet another embodiment, the method comprises monitoring $CO_2$ pressure in the $CO_2$ accumulator; and controlling at least one of the pressure differential unit, the first metering device and the second metering device so that $CO_2$ pressure in the $CO_2$ accumulator is maintain between 300 and 400 psi.

In accordance with an aspect, there is provided a $CO_2$ cooling system, comprising: a compression stage in which $CO_2$ refrigerant is compressed; a cooling stage in which the $CO_2$ refrigerant releases heat; an evaporation stage in which the $CO_2$ refrigerant, having released heat in the cooling stage, absorbs heat. The evaporation stage comprises: a first evaporation sector and a second evaporation sector; a first metering device for feeding a first portion of the $CO_2$ refrigerant into the first evaporation sector at a first pressure; and a second metering device for feeding a second portion of the $CO_2$ refrigerant into the second evaporation sector at a second pressure; a first $CO_2$ transfer line for transferring the first portion of the $CO_2$ refrigerant from the cooling stage to the first metering device; a second $CO_2$ transfer line for transferring the second portion of the $CO_2$ refrigerant from the cooling stage to the second metering device, the second transfer line comprising a $CO_2$ accumulator located upstream of the second metering device, wherein the first metering device and the second metering device are operated independently from one another. The $CO_2$ cooling system also comprises a plurality of $CO_2$ transfer lines connecting the compression stage, the cooling stage and the evaporation stage, and wherein the $CO_2$ refrigerant is circulable in a closed-loop circuit.

In an embodiment, the $CO_2$ cooling system further comprises a $CO_2$ liquid receiver located upstream of the first metering device and the $CO_2$ accumulator and the second transfer line extending from the $CO_2$ liquid receiver to the second metering device further comprises a pressure differential unit mounted between the $CO_2$ liquid receiver and the $CO_2$ accumulator. The second $CO_2$ transfer line can originate from the $CO_2$ liquid receiver.

In accordance with another aspect, there is provided a method for operating a $CO_2$ cooling system. The $CO_2$ cooling system comprises: a compression stage in which $CO_2$ refrigerant is compressed; a cooling stage in which the $CO_2$ refrigerant releases heat; and an evaporation stage comprising a first evaporation sector with a first metering device and a second evaporation sector with a second metering device and in which the $CO_2$ refrigerant having released heat in the cooling stage, absorbs heat. The method comprises: circulating a first portion of the $CO_2$ refrigerant between the cooling stage and the first metering device; operating the first metering device to feed the first portion of the $CO_2$ refrigerant to the first evaporation sector, at a first pressure; circulating a second portion of the $CO_2$ refrigerant between the cooling stage and a $CO_2$ accumulator through a pressure-differential unit and then between the $CO_2$ accumulator and the second metering device; operating the second metering device independently from the first metering device, so as to feed the second portion of the $CO_2$ refrigerant to the second evaporation sector, at a second pressure, lower than the first pressure; and circulating the $CO_2$ refrigerant between the evaporation stage, the compression stage and the cooling stage in a closed-loop circuit.

In accordance with a further aspect, there is provided a $CO_2$ cooling system for an ice-playing surface, comprising: a compression stage in which $CO_2$ refrigerant is compressed;

a cooling stage in which the $CO_2$ refrigerant releases heat; a $CO_2$ liquid receiver in which the $CO_2$ refrigerant is accumulated in liquid and gaseous states; an evaporation stage in which the $CO_2$ refrigerant, having released heat in the cooling stage, absorbs heat. The evaporation stage comprises: a first evaporation sector and a second evaporation sector; a first metering device for feeding $CO_2$ refrigerant into the first evaporation sector at a first pressure; and a second metering device for feeding $CO_2$ refrigerant into the second evaporation sector at a second pressure. The first metering device and the second metering device are operated independently from one another. The $CO_2$ cooling system further comprises a plurality of $CO_2$ transfer lines connecting the compression stage, the cooling stage, the $CO_2$ liquid receiver and the evaporation stage and wherein the $CO_2$ refrigerant is circulable in a closed-loop circuit.

In accordance with still another aspect, there is provided a method for operating a $CO_2$ cooling system for an ice-playing surface. The $CO_2$ cooling system comprises: a compression stage in which $CO_2$ refrigerant is compressed; a cooling stage in which the $CO_2$ refrigerant releases heat; a $CO_2$ liquid receiver in which the $CO_2$ refrigerant is accumulated in liquid and gaseous states; and an evaporation stage comprising first and second evaporation sectors and in which the $CO_2$ refrigerant having released heat in the cooling stage, absorbs heat. The method comprises: circulating the $CO_2$ refrigerant in a closed-loop circuit between the compression stage, the cooling stage, the $CO_2$ liquid receiver and the evaporation stage; and independently controlling a first pressure of the $CO_2$ refrigerant in the first evaporation sector and a second pressure of the $CO_2$ refrigerant in the second evaporation sector.

BRIEF DESCRIPTION OF THE DRAWINGS

FIG. 4 includes FIG. 4A is a technical plan of a $CO_2$ cooling system according to another embodiment, wherein the $CO_2$ cooling system is designed to cool down an ice-covered surface of an ice rink; FIGS. 4B and 4C are close-up views of portions of the technical plan of FIG. 4A;

FIG. 5 includes FIG. 5A is a technical plan of a $CO_2$ cooling system according to yet another embodiment, wherein the $CO_2$ cooling system is designed to cool down an ice-covered surface of an ice rink; FIGS. 5B and 5C are close-up views of portions of the technical plan of FIG. 5A; and FIG. 6 is the legend of FIGS. 4 and 5.

It will be noted that throughout the appended drawings, like features are identified by like reference numerals.

DETAILED DESCRIPTION

Figure 1:
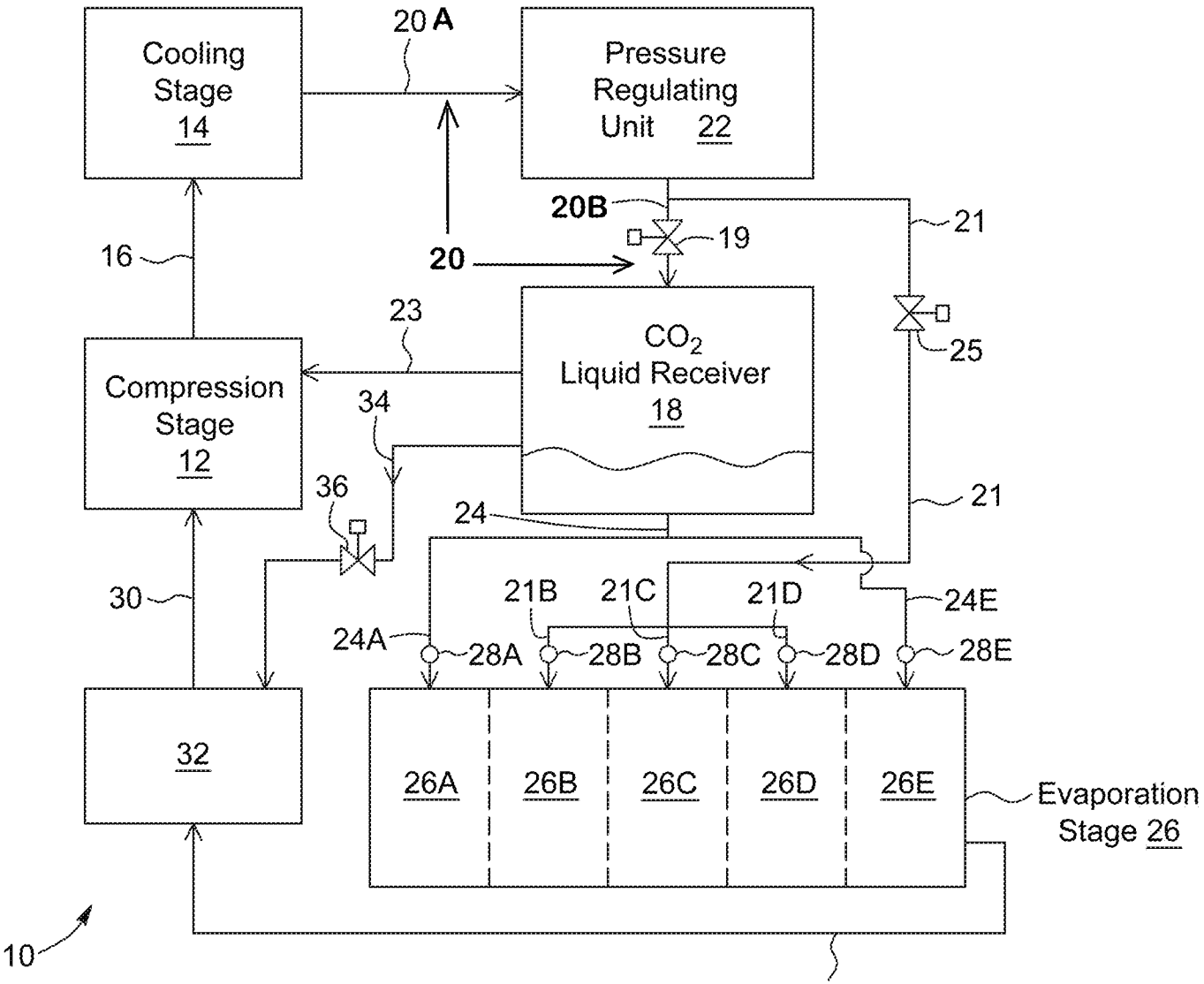
FIG. 1 is a block diagram of a $CO_2$ cooling system according to an embodiment, wherein the $CO_2$ cooling system includes multiple refrigerant metering devices.

Referring to FIG. 1, a $CO_2$ cooling system 10 according to an embodiment is shown. The $CO_2$ cooling system 10 can be a $CO_2$ air-conditioning system of the type used to cool rooms such as computer server rooms. Alternatively, the $CO_2$ cooling system 10 can be a refrigeration system of the type used to cool ice-playing surfaces including curling, hockey, and skating ice rinks, supermarket refrigerators and freezers, refrigerated rooms, and the like.

The $CO_2$ cooling system 10 is designed to independently control the feeding of $CO_2$ refrigerant in different sectors of an ice-covered surface or a portion of a building. For example, in the case of an ice-playing surface such as an ice hockey rink, several sectors of the ice-covered surface such as the center ice, and the areas around the goals are subjected to more wear than the other sectors of the ice rink. These over-exposed sectors are therefore typically in need of a greater quantity of refrigerant in order to maintain a similar ice quality. More particularly, more water is added as a thin layer to be frozen to rebuild the thickness of the ice. The $CO_2$ cooling system 10 is designed to independently control the amount of $CO_2$ refrigerant which is delivered to each one of the sectors of the ice rink. In other words, a $CO_2$ pressure in an outer section of the ice-playing surface (i.e. the circumference of the ice rink) and in a central section of the ice-playing surface (i.e. the center or the ice rink) are controlled independently. Throughout this disclosure it is understood that an ice-covered surface is used to exemplify the object to be cooled. However, it is also understood that in what follows, the cooled surface can be substituted with a portion of a building such as a room or a floor, a refrigerator, a freezer, or more generally any refrigerated room, closed space or surface.

The $CO_2$ cooling system 10 includes a compression stage 12 in which $CO_2$ refrigerant in a gaseous state is compressed. In some embodiments, the compression stage 12 includes one or several suitable compressors. In some embodiments, the compression stage can include a plurality of compressors. In some embodiments, the compressors can be configured in a parallel configuration, wherein the incoming $CO_2$ refrigerant flow is divided before being supplied to the compressors. The compressor outputs can then be recombined. In some embodiments, the compression stage 12 can include one or more compression units, each including one or more compressors, configured in a parallel configuration. Each one of the compression units can be fed with a different $CO_2$ refrigerant flow. For instance and without being limitative, a first one of the compression units can be fed with $CO_2$ refrigerant exiting an evaporation stage 26 through reservoir or accumulator 32, a second one of the compression units can be fed with $CO_2$ refrigerant exiting a $CO_2$ liquid receiver 18, such as a $CO_2$ condensation reservoir, and a third one of the compression units can be fed with $CO_2$ refrigerant exiting a pressure-regulating unit (not shown). In an embodiment, the compression stage 12 is designed to compress $CO_2$ refrigerant into a sub-critical state or a supercritical state (or transcritical state), as will be described in more details below. However, it is appreciated that the system 10 can be designed to either operate solely in a sub-critical state, solely in a supercritical state, or alternatively in both the sub-critical state and the supercritical state.

The $CO_2$ refrigerant exiting the compression stage 12 is transferred to a cooling stage 14 in $CO_2$ transfer line 16. It is understood by the person skilled in the art that a transfer line can be a direct $CO_2$ connection, such as a conduit or a pipe, between two adjacent components of the $CO_2$ cooling system or a succession of $CO_2$ connections between a plurality of components of the $CO_2$ cooling system. In the cooling stage 14, $CO_2$ refrigerant in a compressed state releases heat. In some embodiments, the cooling stage 14 includes a gas cooling stage (or gas cooler). The cooling stage 14 can include one or several cooling units which can be disposed in parallel and/or in series. In some embodiments, in addition to or in replacement of the gas cooling stage, the cooling stage 14 can include a heat reclaim stage wherein heat is reclaimed from $CO_2$ refrigerant by heating a fluid, such as air, water, or another refrigerant, or by heating equipment. The cooling stage 14 can include one or several heating units. Valve(s) can be provided in relation with the cooling stage units to control the amount of $CO_2$ refrigerant directed to each of the cooling stage units.

In some embodiments, at least a portion of the $CO_2$ refrigerant exiting the cooling stage 14 is transferred to a $CO_2$ liquid receiver 18 in $CO_2$ transfer line 20. In some embodiments, a pressure regulating unit 22, such as a valve, is positioned downstream of the cooling stage 14 and upstream of the $CO_2$ liquid receiver 18. In the embodiment shown in FIG. 1, the pressure regulating unit 22 divides $CO_2$ transfer line 20 into two sections 20A and 20B. However, in alternative embodiments, the pressure regulating unit 22 can be mounted adjacent to one of the cooling stage 14 and the $CO_2$ liquid receiver 18. The pressure regulating unit 22 can be any suitable valve or valve assembly that can maintain a pressure differential in line 20, i.e., that can maintain a higher pressure upstream thereof (the higher pressure side) than downstream thereof (the lower pressure side). In some embodiments, the $CO_2$ refrigerant is compressed in a supercritical state and the $CO_2$ refrigerant is returned to the $CO_2$ liquid receiver 18 in a mixture of liquid and gaseous states. Alternatively, in some embodiments where the $CO_2$ refrigerant is compressed in a sub-critical state, the $CO_2$ refrigerant can be directly transferred from the cooling stage 14 to the $CO_2$ condensation reservoir 18 without going through the pressure regulating unit 22 (i.e., by by-passing the pressure regulating unit 22). In other words, in some embodiments, the cooling system 10 can be free of the pressure regulating unit 22 in line 20 when the cooling system is not designed to compress the $CO_2$ refrigerant in a supercritical state.

The $CO_2$ liquid receiver 18 accumulates $CO_2$ refrigerant in a combination of liquid and gaseous states. Gaseous refrigerant accumulating in the $CO_2$ liquid receiver 18 can be circulated back to the compression stage 12 in $CO_2$ transfer line 23. More particularly, line 23 can be used to direct flash gas to the compression stage 12. $CO_2$ transfer line 24 directs liquid $CO_2$ refrigerant from the $CO_2$ liquid receiver 18 to an evaporation stage 26.

In some embodiments, the $CO_2$ refrigerant exiting the cooling stage 14 is transferred to the evaporation stage 26 without going through the $CO_2$ liquid receiver 18. In the embodiment shown in FIG. 1, the $CO_2$ refrigerant can by-pass the $CO_2$ liquid receiver and be transferred directly to the evaporation stage 26 in $CO_2$ transfer line 21. Line 21 by-passes the $CO_2$ liquid receiver and links lines 20 and 24. The pressure differential unit 25, which can be a valve, can be respectively provided in line 21 in order to control the $CO_2$ refrigerant flowing in both paths (i.e., the $CO_2$ refrigerant by-passing the $CO_2$ liquid receiver 18 by going through line 21, or the $CO_2$ refrigerant going through the $CO_2$ liquid receiver 18 in line 20). In an embodiment, line 20, downstream the pressure regulating unit 22 can also be provided with a valve 19 to control the $CO_2$ refrigerant flow directed to the $CO_2$ liquid receiver 18. It is understood that in some embodiments, the $CO_2$ liquid receiver 18 can be absent from the cooling system 10. In such case, the $CO_2$ refrigerant is transferred from the cooling stage 14 to the evaporation stage 26 via $CO_2$ transfer lines 21 and 24, and/or to the reservoir or accumulator 32.

Figure 1A:
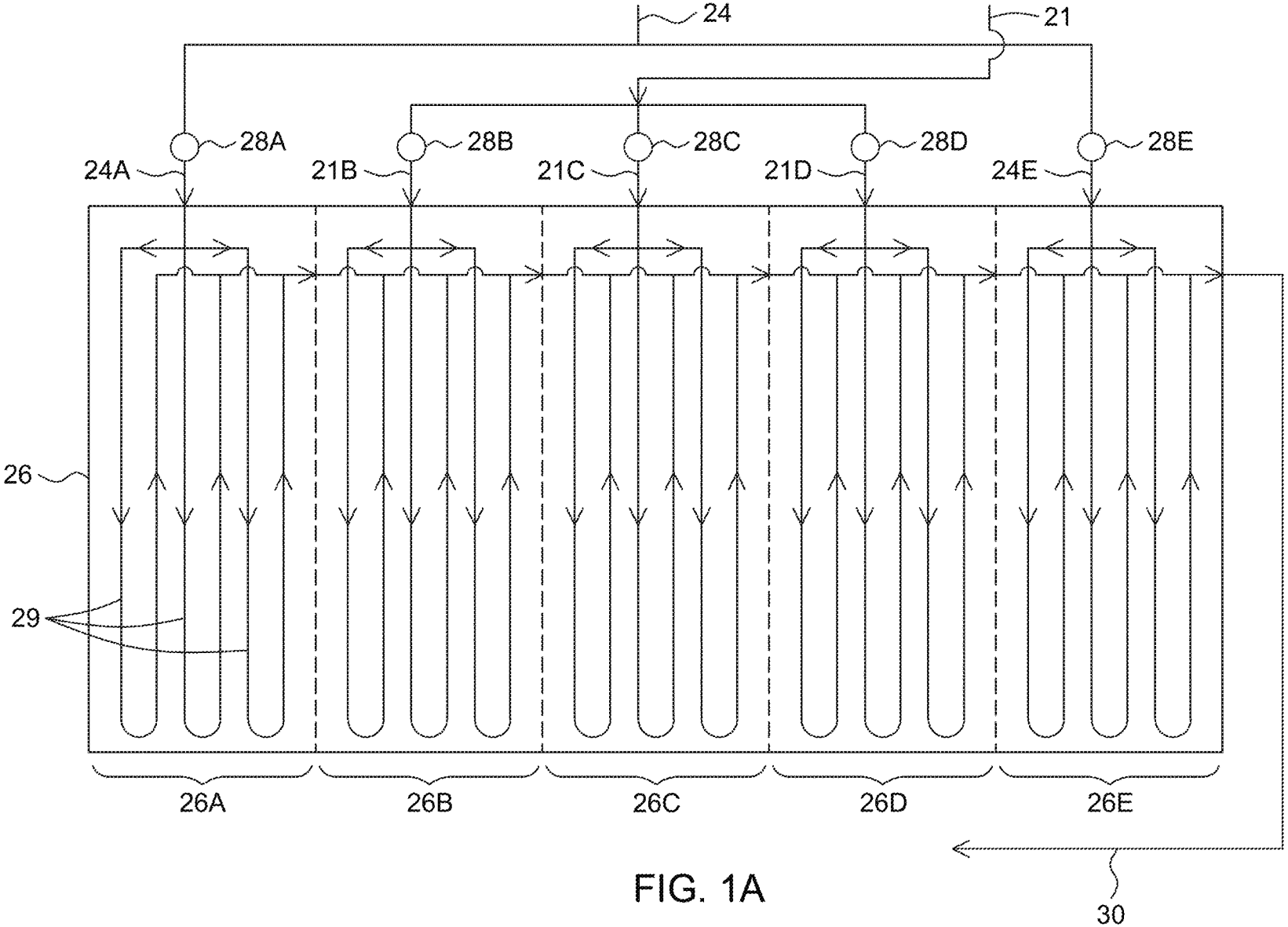
FIG. 1A is a scheme of an evaporation stage of the cooling system of FIG. 1.

In the embodiment shown in FIGS. 1 and 1A, the evaporation stage 26 is divided into a plurality of sectors 26A, 26B, 26C, 26D and 26E. Each one of the sectors 26A to 26E of the evaporation stage 26 can correspond to a sector of the refrigerated surface (or to a sector of the room or zone to refrigerate). The sectors 26A and 26E are connected to line 24 via a respective one of $CO_2$ transfer sub-lines 24A and 24E while the sectors 26B, 26C, and 26D are connected to line 21 via a respective one of $CO_2$ transfer sub-lines 21B, 21C, and 21D. Each one of the sub-lines 24A to 24E includes a metering device 28A, 28B, 28C, 28D and 28E which can hold $CO_2$ refrigerant back in a condensed state and can feed the $CO_2$ refrigerant into the respective one of the sectors 26A to 26E. Each one of the metering devices 28A to 28E can feed $CO_2$ refrigerant into the respective one of the sectors 26A to 26E at a desired pressure. For example, in the case of an ice-covered surface, some of the metering devices 28A to 28E can be configured to release $CO_2$ refrigerant at a higher pressure in sectors where the ice is damaged, while the remaining metering devices can be configured to release $CO_2$ refrigerant at a lower pressure in sectors where the ice is of relatively acceptable quality. In some embodiments, each one of the metering devices 28A to 28E is one of an expansion valve and a pump. It is understood that a metering device can provide a pressure drop point (i.e., an expansion valve) or a pressure increase point (i.e., a pump). In the embodiments shown in FIGS. 1 and 1A, the evaporation stage 26 is divided in five sectors 26A to 26E. However, it should be understood that the evaporation stage 26 can be divided into two sectors, three sectors, four sectors, or as many sectors required. Furthermore, the sectors 26A to 26E fed by a respective one of lines 21 and 24 can vary from the embodiment shown.

In an embodiment, the sectors requiring a higher refrigeration rate are supplied through line 21. In an embodiment, sub-lines 21B, 21C, and 21D are free of metering devices 28B, 28C, and 28D. The pressure differential unit 25 acts as the metering device for the sectors connected to line 21. Thus, the pressure differential unit 25 controls the flowrate of $CO_2$ refrigerant flowing in some sectors of the evaporation stage 26 and, more particularly, the one(s) supplied by line 21.

Now referring to FIG. 1A, the evaporation stage 26 can include one or several heat exchanger(s), such as a circuit of pipes 29, in which the $CO_2$ refrigerant circulates to absorb heat from ambient air, from another fluid or from a solid. If $CO_2$ refrigerant absorbs heat from ambient air, air can be propelled on the circuit of pipes through a fan, for instance to increase heat transfer (i.e., forced air convection). In the non-limiting embodiment shown in FIG. 1A, the circuit of pipes 29 includes a sub-circuit in each one of the sectors 26A to 26E. Each one of the sub-circuits can receive $CO_2$ refrigerant from a respective one of the metering devices 28A to 28E, at a pressure which can be controlled independently in each one of the sectors 26A to 26E, by configuring the respective metering device. In each one of the sectors 26A to 26E, the $CO_2$ refrigerant circulates through the sub-circuit so as to absorb heat. In the non-limiting embodiment shown in FIG. 1A, the $CO_2$ refrigerant is then recovered in $CO_2$ transfer line 30. In other embodiments (not shown in the Figures), it is understood that separate lines can allow recovering $CO_2$ refrigerant from each one of the sectors independently.

In an embodiment, each one of the metering devices 28A to 28E and the pressure differential unit 25, which can be a metering device, is independently controllable. In an embodiment, the metering devices 28A to 28E and pressure differential unit 25 can be operatively connected to a controller (not shown) and their configuration, i.e. opening or speed, can be adjusted in accordance with the required $CO_2$ flowrate.

Figure 2:
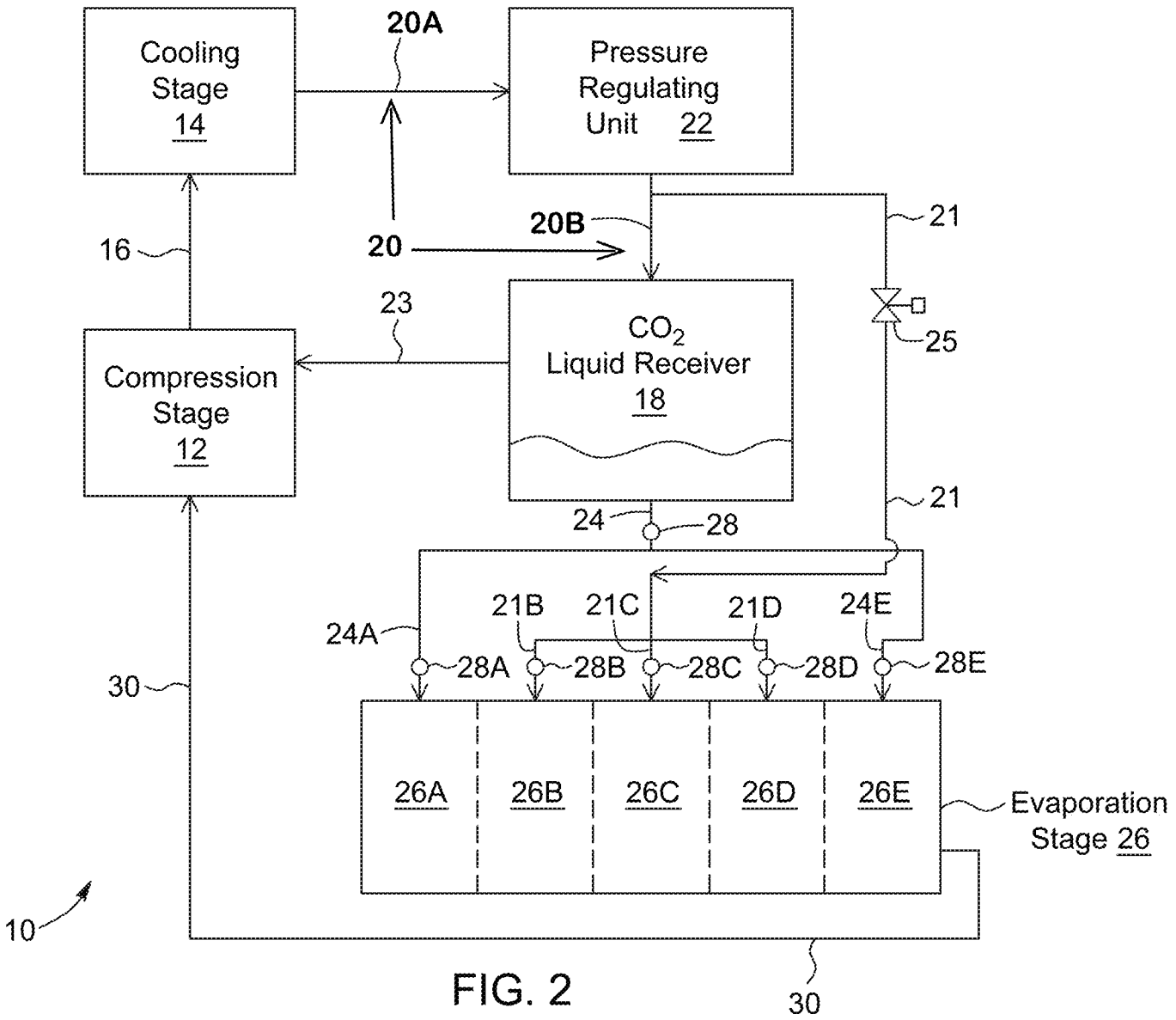
FIG. 2 is a block diagram of a $CO_2$ cooling system according to another embodiment, wherein the $CO_2$ cooling system is free of an accumulator.

The $CO_2$ refrigerant exiting the evaporation stage 26 is directed in $CO_2$ transfer line 30 to the compression stage 12. In the embodiment shown in FIG. 1, line 30 includes a reservoir or accumulator 32. For example, the reservoir or accumulator 32 can be a suction line accumulator. In some scenarios, the suction line accumulator can prevent compressor damage from a sudden surge of liquid refrigerant and oil that could enter the compressor stage 12 from line 30. In some embodiments, $CO_2$ refrigerant can be directed from the $CO_2$ liquid receiver 18 to the reservoir or accumulator 32 in $CO_2$ transfer line 34. In some embodiments, when the $CO_2$ liquid receiver 18 is by-passed or not present in the system, $CO_2$ transfer line (not shown) can transfer $CO_2$ refrigerant from $CO_2$ transfer line 21 to $CO_2$ transfer line 34. Line 34 can be provided with a pressure regulating unit 36 (such as a valve) which can be configured in a closed position, or in an open position so as to let $CO_2$ refrigerant through from the $CO_2$ liquid receiver 18 to the accumulator 32. In some embodiments, as shown in FIG. 2, the accumulator is not present between the evaporation stage 26 and the compression stage 12, and the $CO_2$ refrigerant is directly directed to the compression stage 12 from the evaporation stage 26 in line 30 or from the reservoir or accumulator 32 to the compression stage 12.

In some embodiments, the $CO_2$ refrigerant is transferred from the cooling stage to the evaporation stage by $CO_2$ transfer lines. The evaporation stage 26 comprises first and second evaporation sectors comprising respectively a first and a second metering devices. A first portion of the $CO_2$ refrigerant exiting the cooling stage is transferred by a first $CO_2$ transfer line to the first metering device, and a second portion of the $CO_2$ refrigerant is transferred by a second $CO_2$ transfer line to the second metering device. In some embodiment, the first and second transfer $CO_2$ lines share a conduit section or a pipe section along a portion of their paths, i.e. the $CO_2$ refrigerant flowing in the first transfer line flows in the same conduit or pipe than the $CO_2$ refrigerant flowing in the second transfer line along a portion of their respective paths. The second $CO_2$ transfer line also comprises a $CO_2$ liquid receiver 18. Therefore the second portion of the $CO_2$ refrigerant is circulated between the cooling stage and the $CO_2$ liquid receiver 18 and then between the $CO_2$ liquid receiver 18 and the second metering device. The first portion of the $CO_2$ refrigerant by-passes the $CO_2$ liquid receiver 18, and is therefore circulated between the cooling stage and the first metering device through a pressure differential unit 25. The first and second metering devices can be operated to feed the first and second portions of $CO_2$ refrigerant into the first and second evaporation sectors respectively. Since the first and second metering devices can be operated independently, a $CO_2$ pressure in the first evaporation sector can be different from a $CO_2$ pressure in the second evaporation sector. In some scenario, the $CO_2$ pressure in the first evaporation sector is higher than the $CO_2$ pressure in the second evaporation sector. The $CO_2$ refrigerant is circulated in a closed-loop circuit: between the compression stage to the cooling stage, between the cooling stage and the evaporation stage 26 through the first and second $CO_2$ transfer lines, the second $CO_2$ transfer line comprising the $CO_2$ liquid receiver 18, and finally between the evaporation stage 26 and the compression stage.

Figure 3:
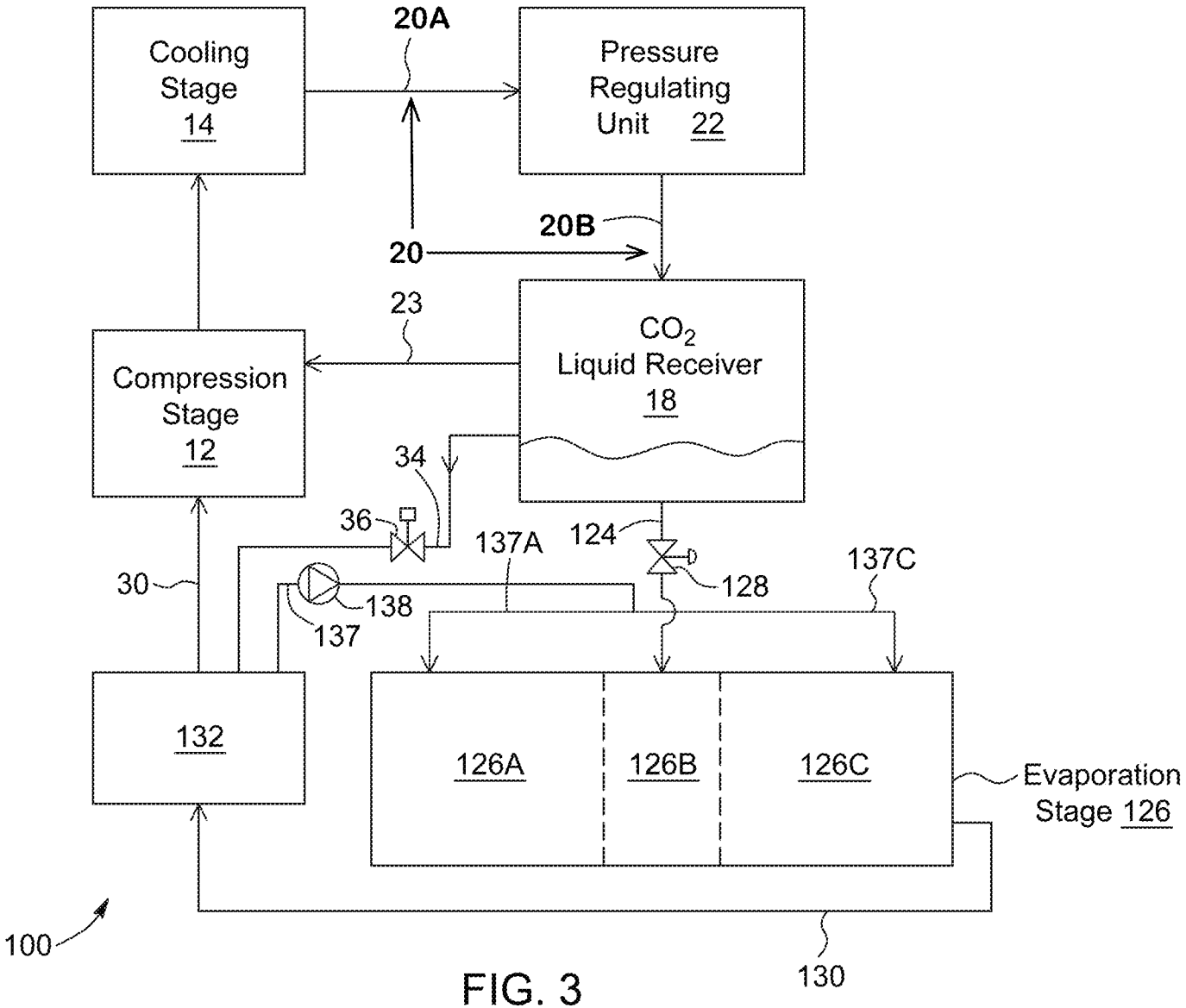
FIG. 3 is a block diagram of a $CO_2$ cooling system according to yet another embodiment, wherein the $CO_2$ cooling system includes a pump and an expansion valve.

Now referring to FIG. 3, there is shown an alternative embodiment of a $CO_2$ cooling system 100, wherein some features are numbered with reference numerals in the 100 series which correspond to the reference numerals of the embodiment of FIG. 1. $CO_2$ transfer line 124 includes a metering device 128 for feeding the liquid $CO_2$ refrigerant into the evaporation stage 126, such that refrigerant can be fed into sector 126B. In the non-limiting embodiment shown, the metering device 128 is an expansion valve, but it is understood that the expansion valve can be replaced with a pump. The pressure of the $CO_2$ refrigerant in sector 126B is controlled by the metering device 128.

Still referring to FIG. 3, $CO_2$ refrigerant is directed to sectors 126A, 126C of the evaporation stage 126 from the reservoir 132, in $CO_2$ transfer line 137. Line 137 includes a metering device 138 for feeding the $CO_2$ refrigerant into the evaporation stage 126. In the non-limiting embodiment shown, the metering device 138 is a pump, but it is understood that the pump can be replaced with an expansion valve. Line 137, through metering device 138, can feed $CO_2$ refrigerant into sectors 126A, 126C of the evaporation stage 126, and the pressure of the $CO_2$ refrigerant in sector 126B is controlled by the metering device 128. Line 137 is divided into $CO_2$ transfer sub-lines 137A and 137C downstream of the metering device 138 (as opposed to upstream of the metering devices 28A to 28E in the embodiment of FIG. 1) such that $CO_2$ refrigerant can be fed into sectors 126A and 126C of the evaporation stage 126. In an alternative embodiment (not shown), it is appreciated that the flow of $CO_2$ refrigerant in each one of the sectors 126A and 126C can be controlled by its own metering device.

In the embodiment shown in FIG. 3, the pressure of $CO_2$ refrigerant in sector 126B is controlled by metering device 128, and the pressure of $CO_2$ refrigerant in sectors 126A and 126C is controlled by metering device 138. However, it should be understood that other configurations are possible. For example, each one of the metering devices 128 and 138 can deliver $CO_2$ refrigerant to one or more sectors of the evaporation stage 126. Furthermore, $CO_2$ transfer line 124 and sub-lines 137A, 137C can be provided with flow-limiting devices downstream of the metering device (not shown in the Figures). Such flow-limiting devices can for example include valves such as solenoid valves, motorized valves, one-way flow control devices, pressure-regulating valves, and the like.

The pressure of $CO_2$ refrigerant in the $CO_2$ liquid receiver 18 is typically higher than the pressure of $CO_2$ refrigerant in the reservoir or accumulator 32 or 132. For example, the pressure of $CO_2$ refrigerant in the $CO_2$ liquid receiver 18 can be between 400 psi and 600 psi, or between 450 psi and 550 psi. For example, the pressure of $CO_2$ refrigerant in the reservoir or accumulator 32 or 132 can be between 300 and 400 psi. In some embodiments, the pressure of $CO_2$ refrigerant in the $CO_2$ liquid receiver 18 is variable and depends on the amount of $CO_2$ refrigerant which is condensed and/or the amount of $CO_2$ refrigerant which is fed into the $CO_2$ liquid receiver 18.

In some embodiments, the pressure of $CO_2$ refrigerant in the reservoir or accumulator 32, 132 is maintained at a substantially constant value. For example, the pressure in the reservoir or accumulator 32, 132 can be set at a given value between 300 and 400 psi (e.g. 350 psi), and $CO_2$ refrigerant can be allowed into the reservoir or accumulator 32, 132 from the evaporation stage 26, 126 when the pressure drops below the given value (for example by opening a valve which can be mounted in $CO_2$ transfer line 30, 130 upstream of the reservoir or accumulator 32, 132). Similarly, when the pressure is higher than the given value, $CO_2$ refrigerant can be forced out of the reservoir or accumulator 32, 132 (for example by opening a valve which can be mounted in line 30, 130 downstream of the reservoir or accumulator 32, 132).

In an embodiment, the sectors requiring a higher refrigeration rate are supplied through the high pressure $CO_2$ liquid receiver 18, via line 124, and the metering device 128 is an expansion valve while the metering device 138 is a pump. Higher $CO_2$ refrigerant flowrates can typically be achieved when supplied from a combination of a higher pressure reservoir and an expansion valve than when supplied from a combination of a lower pressure reservoir and a pump.

As for the embodiments described above in reference to FIGS. 1 and 2, each one of the metering devices 128 and 138 is independently controllable. In an embodiment, the metering devices 128 and 138 can be operatively connected to a controller (not shown) and their configuration, i.e. opening or speed can be adjusted in accordance with the required $CO_2$ flowrate.

In some embodiments, the $CO_2$ refrigerant is transferred from the cooling stage to the evaporation stage by $CO_2$ transfer lines. The evaporation stage comprises a first and a second evaporation sectors, comprising a first and a second metering devices respectively. A first portion of the $CO_2$ refrigerant exiting the cooling stage is transferred by a first $CO_2$ transfer line to the first metering device, and a second portion of the $CO_2$ refrigerant is transferred by a second transfer line to the second metering device. In some embodiment, the first and second transfer lines share a conduit section or a pipe section along a portion of their paths, i.e. the $CO_2$ refrigerant flowing in the first transfer line flows in the same conduit or pipe than the $CO_2$ refrigerant flowing in the second transfer line along a portion of their respective paths. The second transfer line also comprises a $CO_2$ accumulator. Therefore, the second portion of the $CO_2$ refrigerant is circulated between the cooling stage and the $CO_2$ accumulator and then between the $CO_2$ accumulator and the second metering device. The first and second metering devices can be operated to feed the first and second portions of $CO_2$ refrigerant into the first and second evaporation sectors respectively. The second transfer line also comprises a pressure differential unit between the cooling stage and the $CO_2$ accumulator. Since the first and second metering devices can be operated independently, a $CO_2$ pressure in the first evaporation sector can be different from a $CO_2$ pressure in the second evaporation sector. In some scenario, the $CO_2$ pressure in the first evaporation sector is higher than the $CO_2$ pressure in the second evaporation sector. The $CO_2$ refrigerant is circulated in a closed-loop circuit: between the compression stage to the cooling stage, between the cooling stage and the evaporation stage through the first and second $CO_2$ transfer lines, the second $CO_2$ transfer line comprising the $CO_2$ accumulator and the pressure differential unit. The $CO_2$ refrigerant is then circulated between the evaporation stage and the $CO_2$ accumulator, and finally from the $CO_2$ accumulator to the compression stage.

Figure 4A:
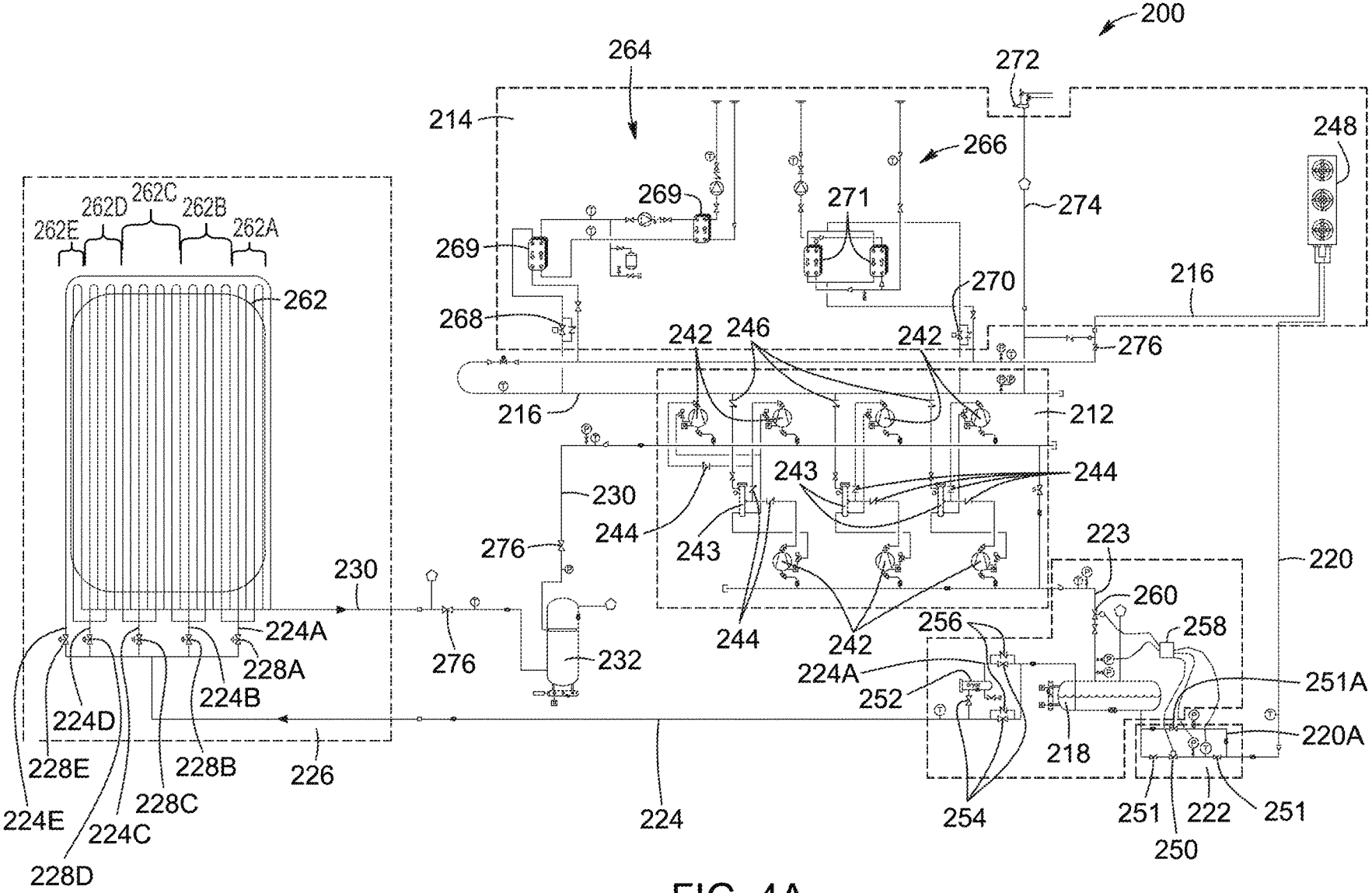
FIGS. 4A, 4B and 4C.
Figure 4B:
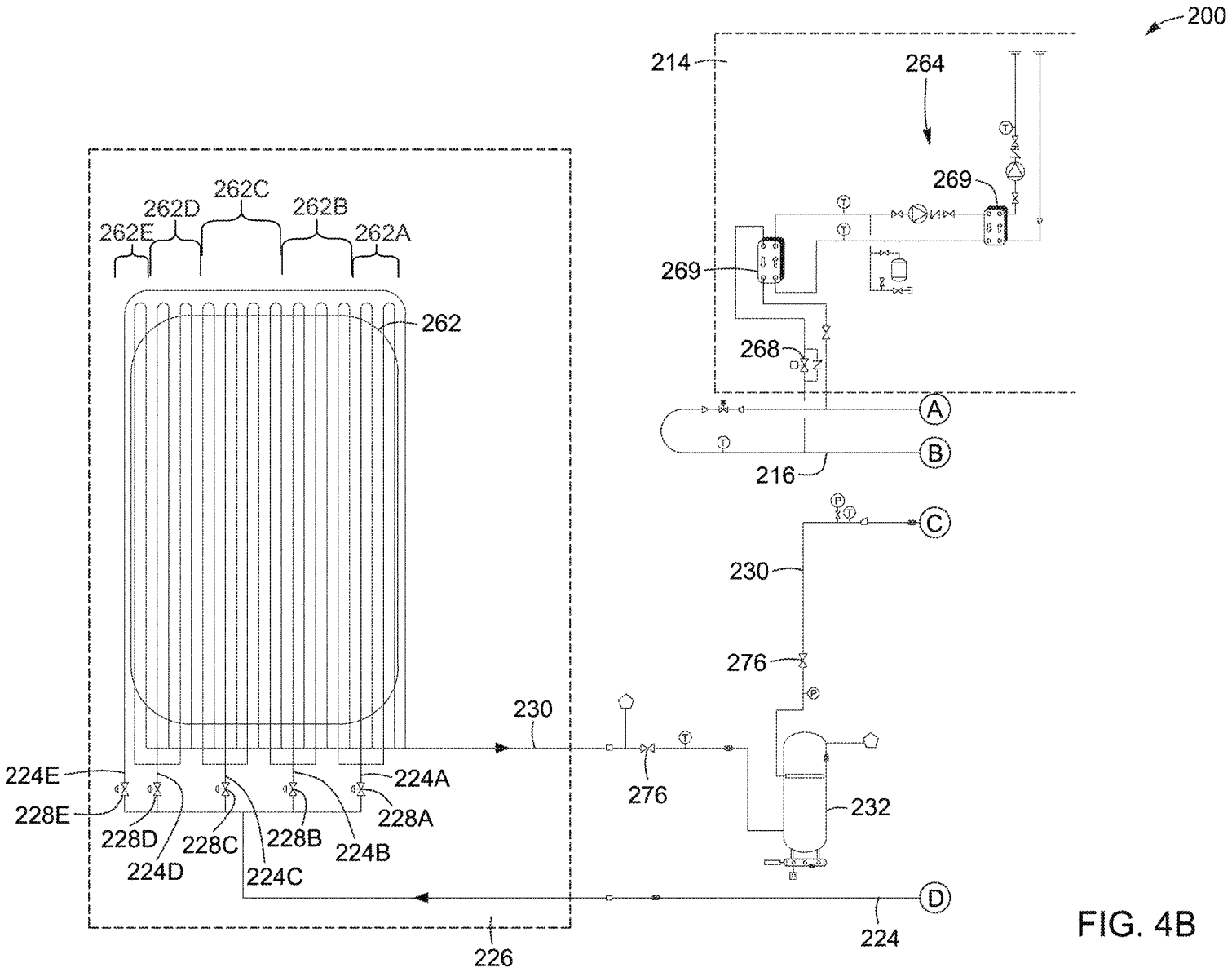
Figure 4C:
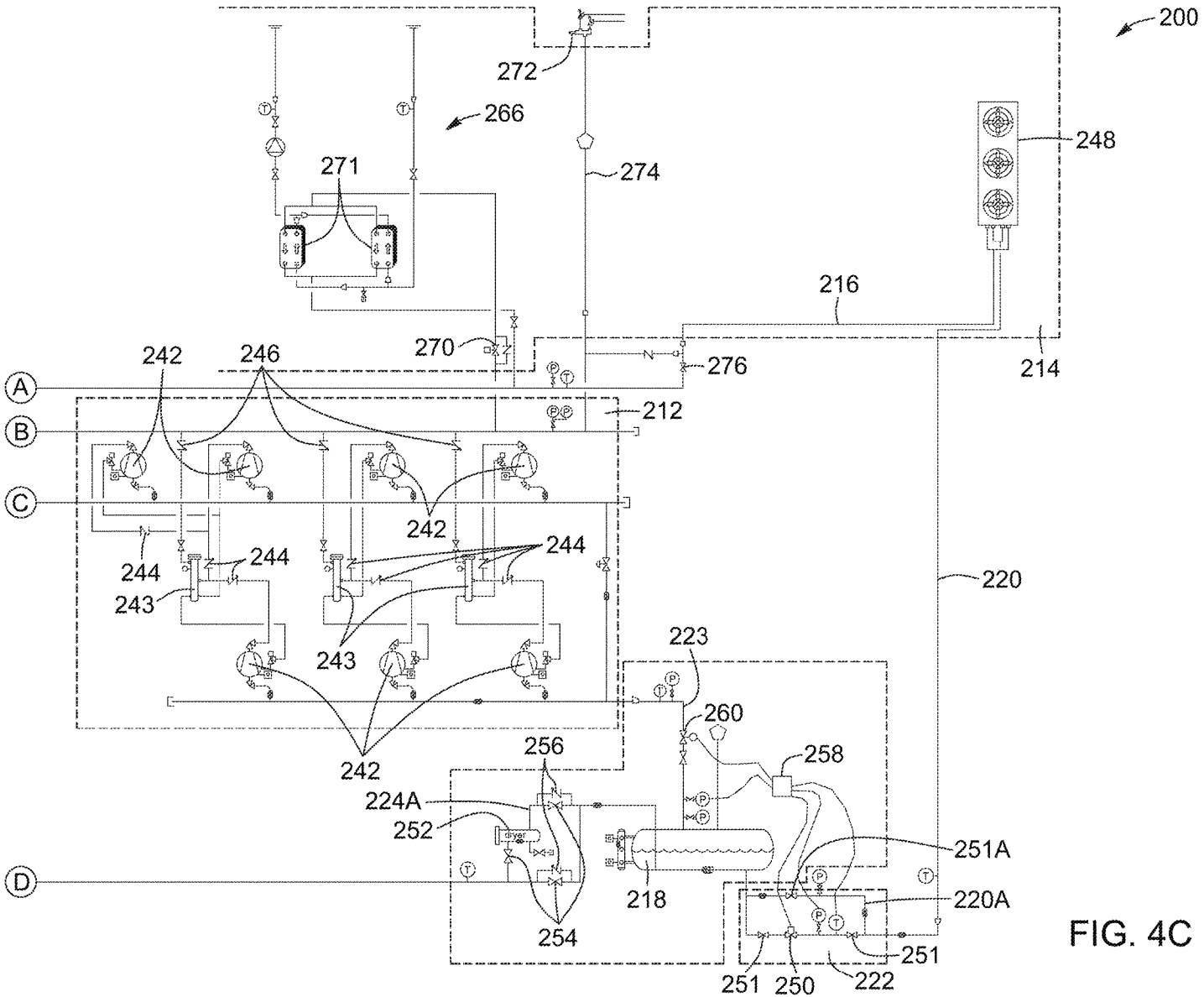

Referring now to FIGS. 4A, 4B and 4C, there is shown an alternative embodiment of a $CO_2$ cooling system wherein the features are numbered with reference numerals in the 200 series which correspond to the reference numerals of the previous embodiments. In the embodiment shown in FIG. 4A, the $CO_2$ cooling system 200 includes two $CO_2$ or accumulators 232 and 218. The $CO_2$ liquid receiver 218 is a condensation reservoir while the reservoir or accumulator 232 is a suction accumulator. The $CO_2$ liquid receiver 218 accumulates $CO_2$ refrigerant in liquid and gaseous states. The suction accumulator 232 provides storage for the $CO_2$ refrigerant directed to compression stage 212 from evaporation stage 226 and in which separation of the $CO_2$ refrigerant in gaseous state from the $CO_2$ refrigerant in liquid state occurs.

The $CO_2$ cooling system 200 is conceived to cool down an ice-covered surface and, more particularly an ice rink which can be located in an arena. It is understood that other configurations and applications can be foreseen.

The $CO_2$ cooling system 200 includes a compression stage 212 in which $CO_2$ refrigerant in a gaseous state is compressed by a plurality of compressors 242 mounted in parallel. The compressors 242 are designed to compress $CO_2$ refrigerant and can compress $CO_2$ refrigerant into a subcritical state or a supercritical state (or transcritical state). Oil separators 243 are mounted in the line(s) extending between the output of the compression stage 212 and the cooling stage 214. Check valves 244 are mounted in the line(s) extending between the outlets of the compressors 242 and the oil separators 243. Check valves 246 are also mounted between the oil separators 244 and the cooling stage 214. The purpose of check valves 214 and 216, as well as other check valves, will be described in more details below.

In the embodiment shown, the $CO_2$ refrigerant exiting the compression stage 212 is transferred to the cooling stage 214 in $CO_2$ transfer line 216 as compressed $CO_2$ refrigerant. In the cooling stage 214, the compressed $CO_2$ refrigerant releases heat. In the embodiment shown in FIG. 4A, the cooling stage 214 includes a gas cooler 248. The $CO_2$ refrigerant exiting the cooling stage 214 is transferred to the $CO_2$ liquid receiver 218 in $CO_2$ transfer line 220. A pressure regulating unit 222 is positioned downstream of the cooling stage 214 and upstream of the $CO_2$ liquid receiver 218. The pressure regulating unit 222 includes a pressure differential valve 250 (also referred to as an ICMTS valve) in line 220. The pressure regulating unit 222 also includes $CO_2$ transfer line 220A which can be used to bypass the pressure differential valve 250. The pressure regulating unit 222 includes two isolation valves 251 (one downstream and one upstream) of the pressure differential valve 250 in line 220, as well as one isolation valve 251A in line 220A. The isolation valves 251, 251A allow selecting one flow path or the other (i.e., allow bypassing the pressure differential unit 250 by going through line 220A, or going through the pressure differential unit 250 in line 220). For example, when the $CO_2$ cooling system 200 is operating in a subcritical state, the pressure differential unit 250 can be by-passed, and when the $CO_2$ cooling system 200 is operating in a transcritical state, the $CO_2$ refrigerant can go through the pressure differential valve 250. It is understood that the purpose of the pressure regulating unit 222 is the same as the purpose of the pressure regulating unit 22 described above.

In some embodiments, such as the embodiment shown in FIG. 4A, the cooling stage 214 includes optional heat reclaim stages 264 and 266. For example, heat reclaim stage 264 can allow recovering heat for domestic hot water by actuation of valve 268 and by operating heat exchangers 269. For example, heat reclaim stage 266 can allow recovering heat for heating the room in which the ice rink 262 is located, by actuation of valve 270 and by operating heat exchangers 271. In such cases, the $CO_2$ refrigerant can then be returned to $CO_2$ transfer line 216 and directed to the gas cooler 248.

Liquid $CO_2$ refrigerant can be directly sent from the $CO_2$ liquid receiver 218 to the evaporation stage 226 in $CO_2$ transfer line 224, or can first be sent through a dryer 252 in line 224A, in order to remove traces of moisture content or humidity that may be present in the $CO_2$ refrigerant. Isolation valves 254 and check valves 256 are provided in lines 224 and 224A so that one flow path or the other can be selected.

Gaseous $CO_2$ refrigerant, such as flash gas, can be recirculated back from the $CO_2$ liquid receiver 218 to the compression stage 212 in $CO_2$ transfer line 223. A pressure controller 258 is used to regulate the pressure in the $CO_2$ liquid receiver 218. The pressure controller 258 is connected to a pressure sensor and a temperature sensor in line 220 upstream of the pressure differential valve 250, as well as to a pressure sensor and an electronic expansion valve 260 in line 223. When the $CO_2$ refrigerant is in a transcritical state, the pressure in the $CO_2$ liquid receiver 218 is controlled by the ICMTS valve 250. When the pressure in the $CO_2$ liquid receiver 218 reaches a certain level, the pressure controller 258 can instruct the electronic expansion valve 260 to release gaseous refrigerant back to the compression stage 212.

$CO_2$ transfer line 224 directs $CO_2$ refrigerant, in liquid state, from the $CO_2$ liquid receiver 218 to the evaporation stage 226. Line 224 is divided into $CO_2$ transfer sub-lines 224A, 224B, 224C, 224D and 224E, each including an expansion valve 228A, 228B, 228C, 228D and 228E. Each of the sub-lines 224A to 224E allows $CO_2$ refrigerant into a respective one of several sectors 262A, 262B, 262C, 262D, 262E of an ice rink 262. In the embodiment shown, the expansion valve 228E delivers $CO_2$ refrigerant in pipes located below and around the ice rink 262 (i.e., below and on the exterior of the ice rink 262), before being fed into $CO_2$ transfer line 230 exiting the evaporation stage 226. Upstream of each one of the expansion valves 228D, 228C, 228B, 228A, the respective sub-line 224D, 224C, 224B and 224A is further divided into three paths (which can be circuits of pipes), each path delivering $CO_2$ refrigerant under a surface of the ice-rink 262 and along the length of the ice rink 262, and circling back to deliver $CO_2$ refrigerant into line 230 existing the evaporation stage 226. The $CO_2$ refrigerant circulating in the pipes can absorb heat from a heat-transfer fluid or solid surrounding the pipes and located under the ice-covered surface. In some scenarios, the heat-transfer fluid contacting the pipes and located under the ice-covered surface is brine. In some scenarios, the heat-transfer fluid contacting the pipes and located under the ice-covered surface is ambient air. In such case, a plurality of fans can be provided to promote air circulation around the pipes containing $CO_2$ refrigerant. The air is drawn around the pipes by the action of the fans, promotes heat exchange, and can then exit through an aperture (not shown in the Figure). This configuration can allow for forced convection around the pipes, which can increase heat transfer. In other words, the above-described cooling system 200 can allow a direct heat transfer between $CO_2$ refrigerant and ambient air, or can be used to cool down gases, liquids, and solids by heat exchange, thereby indirectly transferring heat between the $CO_2$ refrigerant and ambient air. In some scenarios, the pipes are embedded in concrete, below the ice-covered surface and heat transfer can occur with the ambient air.

As for the embodiments described above, each one of the metering devices 228A to 228E is independently controllable. In an embodiment, the metering devices 228A to 228E can be operatively connected to a controller (not shown) and their configuration, i.e. opening or speed, can be adjusted in accordance with the required $CO_2$ flowrate. As mentioned above, the sector(s) corresponding to the center of the ice rink and surrounding the goals, if any, has(have) higher cooling needs and thus require(s) a higher $CO_2$ flowrate.

$CO_2$ refrigerant exiting the evaporation stage 226 is directed to the suction accumulator 232, in line 230. It is understood that the suction accumulator 232 has the same purpose as reservoir or accumulator 32 described above. The gaseous $CO_2$ refrigerant is supplied to the compression stage 212 from the suction accumulator 232 in line 230.

In an alternative embodiment (not shown), one or several sectors of the evaporation stage 226 can be supplied through a line, including a metering device, if connected to the suction accumulator 232, instead of the $CO_2$ liquid receiver 218. For instance, the metering devices 228A, 228E can be pumps mounted to $CO_2$ transfer lines extending between the suction accumulator 232 and the evaporation stage 226.

The $CO_2$ refrigerant circulates in the $CO_2$ cooling system 200 mainly through the action of the compression stage 212. The check-valves which are provided in various $CO_2$ transfer lines of the $CO_2$ cooling system 200 (such as check-valves 246, 256 among others), prevent $CO_2$ refrigerant to be directed in an opposite direction. The check-valves are typically one-way valves which allow $CO_2$ refrigerant circulation in a single direction. For example, check-valves 246 allow $CO_2$ refrigerant to circulate from the compression stage 212 to the cooling stage 214 and/or other optional heat reclaim stages.

A pressure relief valve 272 is provided in a $CO_2$ transfer line 274 extending from $CO_2$ transfer line 216 downstream of the compression stage 212 and the optional heat reclaim stages 264 and 266 and upstream the gas cooler 248. It is appreciated that the location of the pressure relief valve 272, if any, can vary from the embodiment shown. The $CO_2$ cooling system 200 also includes other valves to control the fluid flow therein, and a plurality of suitable sensors, such as temperature and pressure sensors, as it is known in the art. For instance, control valves or isolation valves 276 can be provided in the $CO_2$ transfer lines extending between the $CO_2$ liquid receiver 218 and the evaporation stage 226, and/or between the evaporation stage 226 and the suction accumulator 232, and/or between the suction accumulator 232 and the compression stage 212, and/or between the compression stage 212 and the cooling stage 214, and/or between the cooling stage 214 and the $CO_2$ liquid receiver 218, and/or at any other suitable location. In some scenarios, the control valves can be configured to control the $CO_2$ expansion, and therefore the temperature.

Figure 5A:
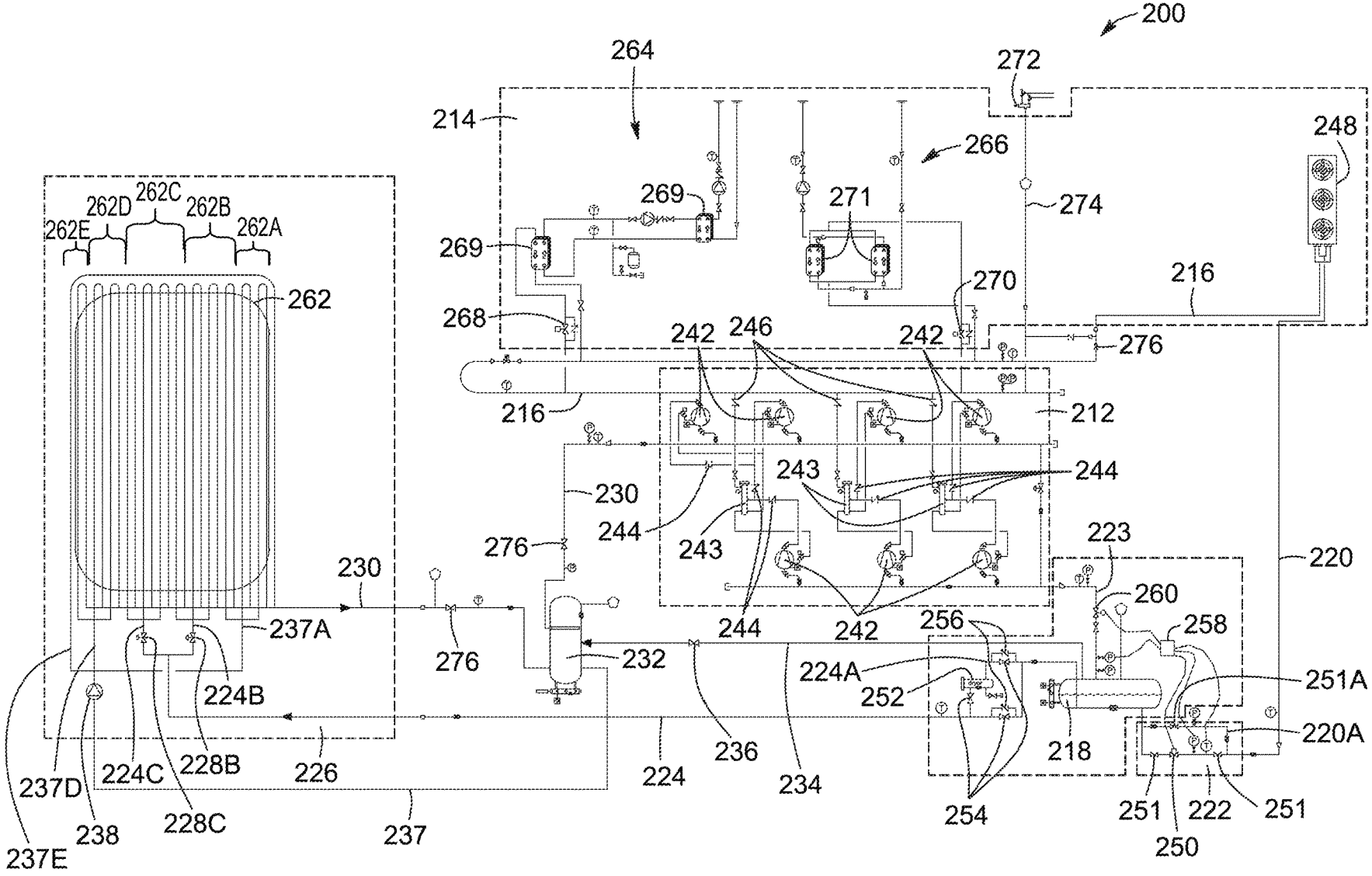
FIGS. 5A, 5B and 5C.
Figure 5B:
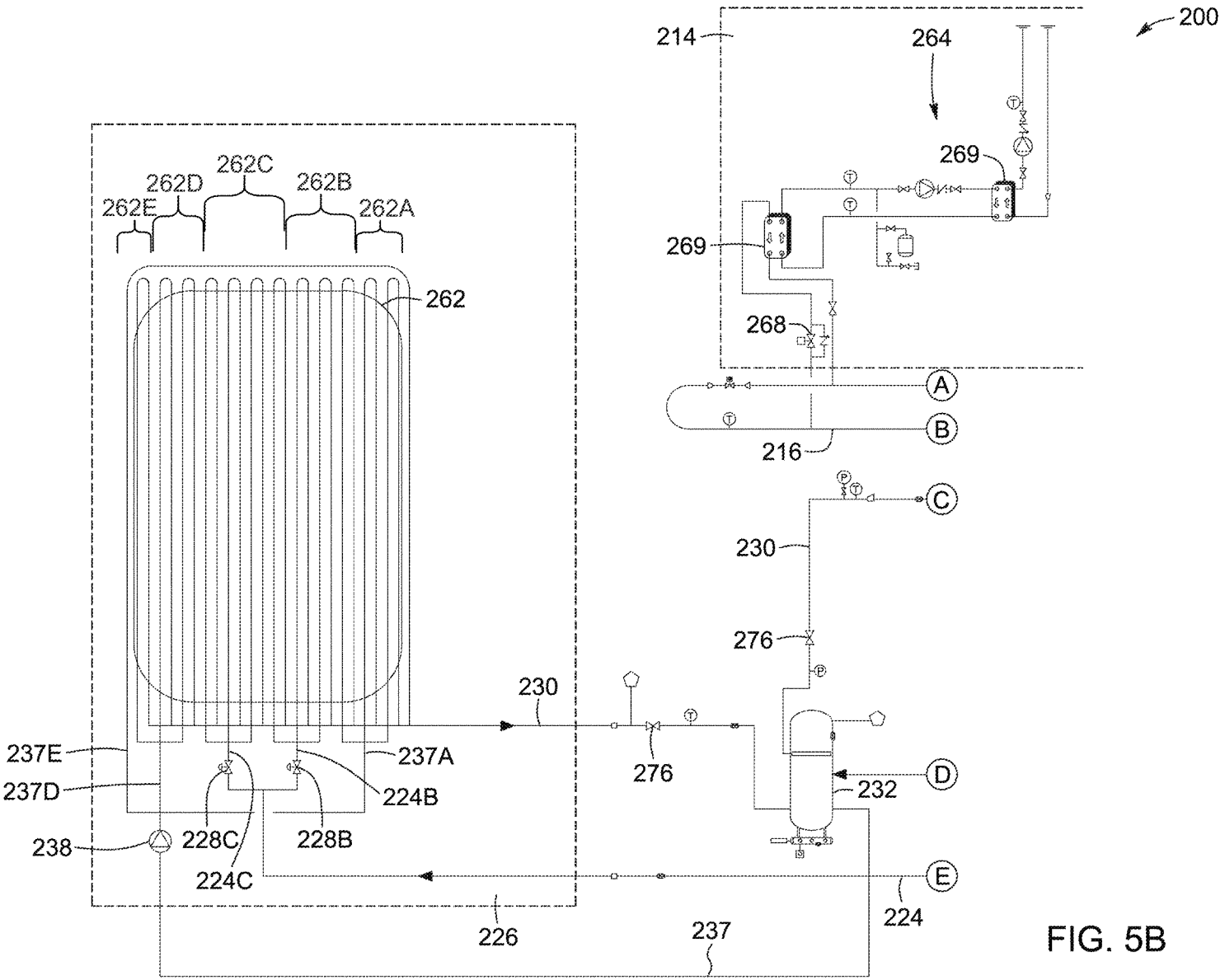
Figure 5C:
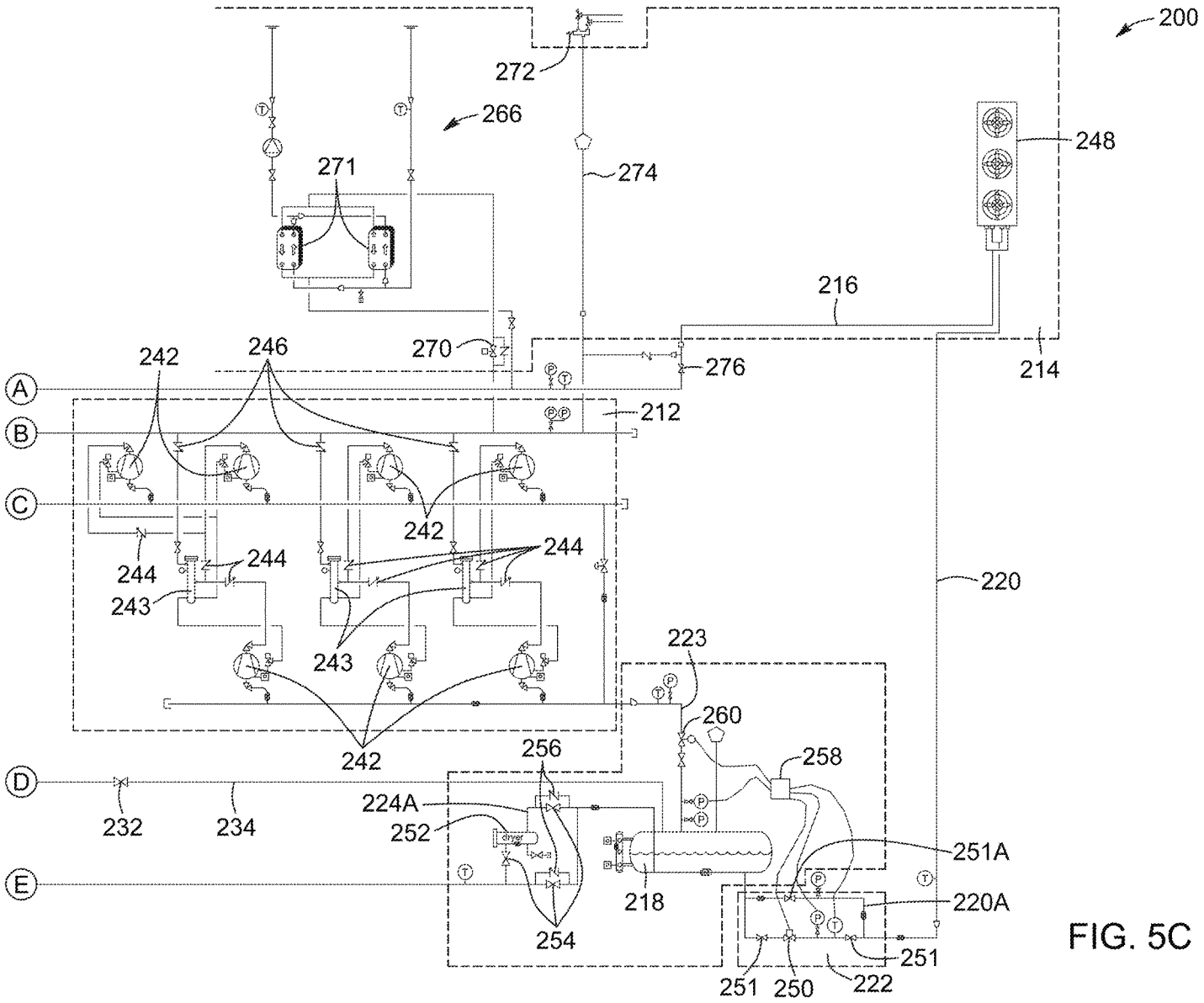

Referring now to FIGS. 5A, 5B and 5C, there is shown yet another embodiment of a $CO_2$ cooling system wherein the features are numbered with reference numerals in the 200 series which correspond to the reference numerals of the previous embodiments. In the embodiment shown in FIG. 5A, the $CO_2$ cooling system 200 includes two $CO_2$ reservoirs or accumulators 232 and 218. The reservoir 218 is a $CO_2$ liquid receiver while the reservoir or accumulator 232 is a suction accumulator. The $CO_2$ liquid receiver 218 accumulates $CO_2$ refrigerant in liquid and gaseous states. The suction accumulator 232 provides storage for the $CO_2$ refrigerant directed to compression stage 212 from evaporation stage 226 and in which separation of the $CO_2$ refrigerant in gaseous state from the $CO_2$ refrigerant in liquid state occurs.

In the embodiment shown, gaseous $CO_2$ refrigerant can be directed from the $CO_2$ liquid receiver 218 to the suction accumulator 232 in $CO_2$ transfer line 234. It is understood that isolation valve 236, located in line 234, has the same purpose as valve 36 described above. Liquid $CO_2$ refrigerant is directed from the $CO_2$ liquid receiver 218 to the evaporation stage 226 in $CO_2$ transfer line 224, and liquid $CO_2$ refrigerant is directed from the suction accumulator 232 to the evaporation stage 226 in $CO_2$ transfer line 237. Line 224 is divided into sub-lines 224B and 224C, each including a respective expansion valve 228B and 228C. Line 237 includes a pump 238 for pumping $CO_2$ refrigerant in sub-lines 237A, 237D and 237E. Typically, the $CO_2$ liquid receiver 218 operates at a higher pressure than the suction accumulator 232. As a non-limiting example, the $CO_2$ liquid receiver can operate at between 450 and 550 psi (e.g. 500 psi), and the suction accumulator can operate at between 300 psi and 400 psi (e.g. 350 psi). The expansion valves 228B and 228C can be configured to deliver a high load of $CO_2$ refrigerant into the central portion of the ice rink, while the pump 238 can be configured to deliver a lower load of $CO_2$ refrigerant compared to the expansion valves 228B and 228C. Typically, the ice of an ice-covered surface such as an ice rink 262 of an arena is more easily damaged in certain sectors, such as center ice. In the embodiment shown, it is therefore possible to deliver a high flowrate of $CO_2$ refrigerant to certain sectors (e.g. the center of the ice rink 262), while a lower flowrate of $CO_2$ refrigerant can be delivered to other sectors (e.g. the side sectors of the ice rink 262). It is understood that the pump 238 and each one of the expansion valves 228B, 228C can be operated and configured independently from one another. Furthermore, each one of the sublines 237A, 224B, 224C, 237D and 237E can be provided with flow-limiting devices downstream of the pump and/or each one of the expansion valves (not shown in the Figures). Such flow-limiting devices can for example include valves such as solenoid valves, motorized valves, one-way flow control devices, pressure-regulating valves, and the like.

It is understood that combinations of different embodiments of the $CO_2$ cooling systems 10, 100 and 200 described herein can be foreseen. For instance, as a non-limiting example, the several pumps (such as pump 138 of FIG. 3) can be used without using expansion valves in order to control the pressure of $CO_2$ refrigerant in different sectors of the evaporation stage. As another non-limiting example, one or more pumps (such as pump 138 of FIG. 3) can be used in combination with one or more expansion valves (such as valve 128 of FIG. 3), in the $CO_2$ cooling system 200.

It is appreciated that the cooling systems 10, 100 and 200 can include several $CO_2$ transfer lines extending in parallel or, in some embodiments, $CO_2$ transfer lines can combine. For instance and without being limitative, in the evaporation stage 26 shown in FIG. 1A, the circuit of pipes can combine into line 30 after exiting the evaporation stage 26. In alternative embodiments, the sub-lines can exit the evaporation stage 26 without combining in a single line 30, and can instead extend in parallel to deliver $CO_2$ refrigerant directly to the reservoir or accumulator 32 and/or the compression stage 12.

In some embodiments, a method for operating a $CO_2$ cooling system is provided. The $CO_2$ cooling system includes a compression stage in which $CO_2$ refrigerant is compressed; a cooling stage in which the $CO_2$ refrigerant releases heat; a $CO_2$ liquid receiver in which the $CO_2$ refrigerant is accumulated in liquid and gaseous states; and an evaporation stage including first and second evaporation sectors and in which the $CO_2$ refrigerant having released heat in the cooling stage, absorbs heat. For example, the method allows operating $CO_2$ cooling system including any one of $CO_2$ cooling systems 10, 100 and 200 described above.

The method includes circulating the $CO_2$ refrigerant in a closed-loop circuit between the compression stage, the cooling stage and the evaporation stage. The method also includes independently controlling a first pressure of the $CO_2$ refrigerant in the first evaporation sector and a second pressure of the $CO_2$ refrigerant in the second evaporation sector. In some embodiments, the evaporation stage can include more than two evaporation sectors, such as three, four, five or more evaporation sectors. In such cases, it is understood that the method can include independently controlling the pressure of the $CO_2$ refrigerant in at least two of the evaporation sectors. In some scenarios, the pressure of $CO_2$ refrigerant can be controlled in all of the sectors.

It should be understood that in the expression "independently controlling the pressure of $CO_2$ refrigerant" in a given sector, it is meant that pressure variations in the given sector do not substantially affect the pressure of $CO_2$ refrigerant in other sectors, including neighboring sectors. In other words, each one of the independently controlled sectors can be controlled by one or more metering device(s) which is/are not tied to other metering device(s) controlling other independent sectors of the evaporation stage. The independent control can be carried out by operatively connecting the metering devices to a controller.

The cooling system described above and the associated method can reduce the total energy requirement of the $CO_2$ cooling system by allowing independently controlling the amount of $CO_2$ refrigerant being provided in certain sectors of the evaporation stage.

It will be appreciated that the method to operate the $CO_2$ cooling system described herein may be performed in the described order, or in any suitable order.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention. The scope of the invention is therefore intended to be limited solely by the scope of the appended claims.

The invention claimed is:

1. A $CO_2$ cooling system, comprising:

a compression stage in which $CO_2$ refrigerant is compressed;

a cooling stage in which the compressed $CO_2$ refrigerant releases heat;

a $CO_2$ liquid receiver receiving $CO_2$ refrigerant from the cooling stage;

an evaporation stage in which the $CO_2$ refrigerant, having released heat in the cooling stage, absorbs heat, wherein the evaporation stage comprises a first evaporation sector and a second evaporation sector;

a $CO_2$ accumulator receiving $CO_2$ refrigerant exiting the evaporation stage, wherein a first portion of the $CO_2$ refrigerant from the $CO_2$ accumulator is directed to the compression stage;

a first metering device mounted downstream of the $CO_2$ liquid receiver and upstream of the first evaporation sector, wherein the first metering device is an expansion valve feeding $CO_2$ refrigerant from the $CO_2$ liquid receiver into the first evaporation sector;

a second metering device mounted downstream of the $CO_2$ accumulator and upstream of the second evaporation sector, wherein the second metering device is a pump pumping a second portion of the $CO_2$ refrigerant from the $CO_2$ accumulator into the second evaporation sector;

a first transfer line transferring a first portion of the $CO_2$ refrigerant from the cooling stage to the first metering device; and a second transfer line transferring a second portion of the $CO_2$ refrigerant from the cooling stage to the $CO_2$ accumulator and then from the $CO_2$ accumulator to the second metering device;

wherein the $CO_2$ liquid receiver and the $CO_2$ accumulator are separate reservoirs;

wherein the first metering device and the second metering device are operated independently from one another, $CO_2$ pressure in the first evaporation sector being different than $CO_2$ pressure in the second evaporation sector;

wherein the $CO_2$ refrigerant is circulatable in a closed-loop circuit;

wherein the evaporation stage comprises a circuit of pipes extending under an ice-playing surface with the circuit of pipes including at least one first pipe line corresponding to the first evaporation sector and at least one second pipe line corresponding to the second evaporation sector; and wherein the first pipe line extends below a central section of the ice-playing surface and the second pipe line extends below an outer section of the ice-playing surface.

2. The $CO_2$ cooling system of claim 1, wherein:

$CO_2$ pressure in the first evaporation sector is higher than $CO_2$ pressure in the second evaporation sector.

3. The $CO_2$ cooling system of claim 1, wherein the first transfer line and the second transfer line share a conduit section or a pipe section along a portion of their paths.

4. The $CO_2$ cooling system of claim 1, wherein the second transfer line comprises a pressure differential unit between the cooling stage and the $CO_2$ accumulator.

5. The $CO_2$ cooling system of claim 4, wherein the pressure differential unit is a valve.

6. The $CO_2$ cooling system of claim 1, wherein the ice-playing surface is an ice hockey rink, a curling rink or a skating rink.

* * * * *